United States Patent [19]

Motoki et al.

[11] 4,173,863

[45] Nov. 13, 1979

[54] ANALOG QUARTZ TIMEPIECE

[75] Inventors: Jinro Motoki, Hoya; Singo Ichikawa, Sayama; Kenzi Miyasaka, Tokyo; Hiroyuki Uematsu, Kunitachi; Mitsuhiro Murata, Tokyo; Hideyuki Kawashima, Higashi-Kurume; Yuri Inoue, Higashimurayama; Masae Ohkubo, Niiza; Mituo Oooka, Tokorozawa, all of Japan

[73] Assignee: Citizen Watch Company Limited, Tokyo, Japan

[21] Appl. No.: 752,648

[22] Filed: Dec. 20, 1976

[30] Foreign Application Priority Data

| | | | |
|---|---|---|---|
| Dec. 25, 1975 | [JP] | Japan | 50-159485 |
| Mar. 19, 1976 | [JP] | Japan | 51-30437 |
| Apr. 9, 1976 | [JP] | Japan | 51-039297 |
| Apr. 10, 1976 | [JP] | Japan | 51-040531 |
| Apr. 10, 1976 | [JP] | Japan | 51-40532 |
| Apr. 19, 1976 | [JP] | Japan | 51-48000[U] |
| Apr. 19, 1976 | [JP] | Japan | 51-44235 |
| Jun. 22, 1976 | [JP] | Japan | 51-73538[U] |
| Jun. 23, 1976 | [JP] | Japan | 51-73537 |
| Jun. 23, 1976 | [JP] | Japan | 51-74201 |
| Sep. 14, 1976 | [JP] | Japan | 51-110497 |
| Sep. 14, 1976 | [JP] | Japan | 51-110498 |
| Sep. 14, 1976 | [JP] | Japan | 51-110499 |

[51] Int. Cl.[2] ..... G04B 27/00

[52] U.S. Cl. ..... 58/85.5; 58/23 R; 58/57

[58] Field of Search ..... 58/34, 35 R, 35 W, 24 R, 58/23 R, 23 AC, 85.5, 57

[56] References Cited

U.S. PATENT DOCUMENTS

| | | | |
|---|---|---|---|
| 3,538,703 | 10/1970 | Walton | 58/23 R |
| 3,943,696 | 3/1976 | Portmann | 58/23 R |
| 3,953,964 | 5/1976 | Suppa | 58/85.5 |

*Primary Examiner*—Gene Z. Rubinson
*Assistant Examiner*—Leonard W. Pojunas, Jr.
*Attorney, Agent, or Firm*—Frank J. Jordan

[57] ABSTRACT

An analog quartz timepiece having a manually operated external control member, and a correction signal generation circuit controlled by the external control member to generate low speed and high speed correction signals when the external control member is actuated for a short period of time and for a predetermined time interval, respectively, by which a stepping motor is driven at a selected speed to perform time correction. The timepiece alo includes a click mechanism operative to shift an hours hand step-wise from any optional position without affecting a minutes hand and a seconds hand. The timepiece further includes a seconds zero-reset mechanism operative to reset the seconds hand to zero.

37 Claims, 44 Drawing Figures

FREQUENCY STANDARD
290
FREQUENCY CONVERTER
292
1/10HZ
64HZ
WAVEFORM CONVERTING CIRCUIT
294
1/10HZ
64HZ
296
DRIVER CIRCUIT
316
272
270
310
308
306
304
302
300
TIMER CIRCUIT
To R
312
DIFFERENTIATING CIRCUIT
314
VDD
S
298
299
Vss

FREQUENCY STANDARD
326
FREQUENCY CONVERTER
328
1/10HZ
4 HZ
64 HZ
WAVEFORM CONVERTING CIRCUIT
330
1/10 HZ
4 HZ
64 HZ
331
336
334
332
350
DRIVER CIRCUIT
352
354
346
DIFFERENTIATING CIRCUIT
348
VSS
VSS VSS VSS
344
342
340
SW
338
VDD

ANALOG QUARTZ TIMEPIECE

This invention relates to analog electronic timepieces equipped with electro-mechanical transducers for driving time-indicating hands to display time and, more particularly, to a time correction mechanism for such timepieces.

In recent years analog quartz wristwatches have become quite popular and the conventional ones which are available are more accurate than mechanical wristwatches. Despite these developments and the fact the time indicating hands of analog quartz wristwatches are now driven by a stepping motor, there have been almost no technical improvements as far as the time indicating mechanism of these timepieces is concerned. In other words in conventional analog quartz wristwatches a time correction is performed by winding an external control member such as a crown fixed to the widely known winding stem. Manipulation of this control member is mechanically coupled to a time-indicating mechanism which sets the hands of the timepiece by means of time setting wheels such as clutch and setting wheels. Thus, even analog quartz wrist-watches have had to be equipped with hand setting mechanisms such as clutch levers, time setting wheels such as clutch wheels and slip mechanisms such as center wheels and cannon pinions.

A hand setting mechanism, time setting wheels and a slip mechanism when installed within the movement of a timepiece occupy a great deal of space and compact, slim wristwatches are thus difficult to manufacture. These mechanisms are extremely complex, subject to malfunction, unreliable and are costly to manufacture, assemble and adjust. Accordingly, since analog quartz wrist-watches are so much more accurate and require so fewer time corrections than mechanical wristwatches it is extremely unreasonable to employ the same kind of time correction mechanism in both situations.

It is, therefore, an object of the present invention to provide an analog quartz timepiece which can obviate the aforementioned shortcomings encountered in the prior art.

It is another object of the present invention to provide an analog quartz timepiece arranged to permit a time correction without requiring a hand setting mechanism, time setting wheels or a slip mechanism.

It is another object of the present invention to provide an analog quartz timepiece including a time correction circuit by which a time correction can be easily and accurately performed within the shortest period of time.

It is still another object of the present invention to provide an analog quartz timepiece including a time correction circuit which is simple in construction and highly reliable in operation.

It is still another object of the present invention to provide an analog quartz timepiece including a time correction circuit which can be manufactured in low cost.

It is a further object of the present invention to provide an analog quartz timepiece incorporating a time correction circuit equipped with a power conserving means.

These and other objects, features and advantages of the present invention will become more apparent from the following description when taken in conjunction with the accompanying drawings, in which.

Figure 1:
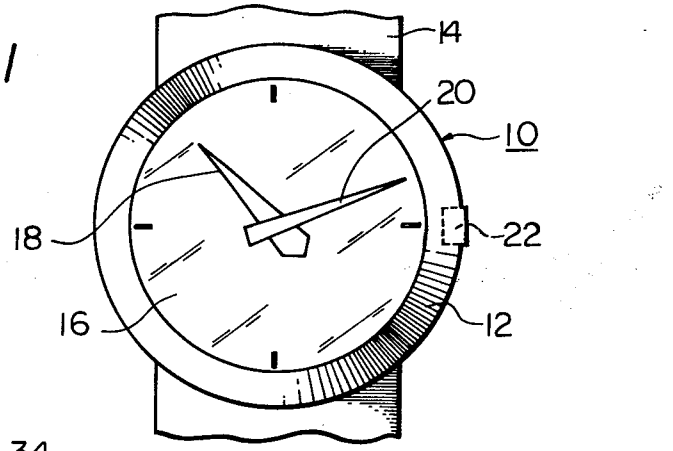
FIG. 1 is a plan view showing the external appearance of a 2-hand analog quartz timepiece employing a single push-button switch for a time correction.

Referring now to FIG. 1, there is shown a novel watch of the present invention which is generally indicated at 10. The watch 10 is constructed to fit into a watch case 12 of a conventional size. The case 12 shown connected to a wristwatch bracelet 14 and includes a dial 16 and time indicating hands composed of minutes hand 18 and hours hands 20. Mounted on the case 12 is a push-button 22 which may be actuated by a pin or bar of a small size for performing time correction in a manner as will be described in detail hereinafter.

Figure 2:
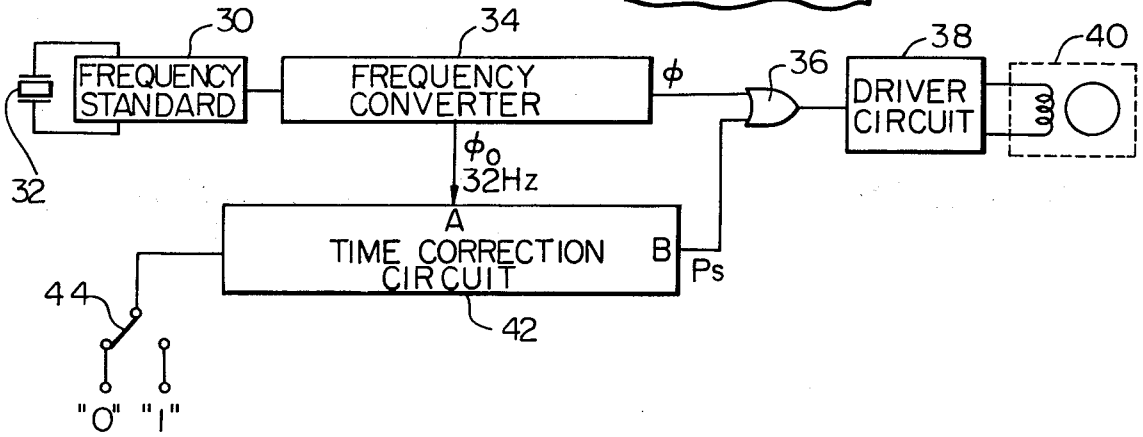
FIG. 2 is a block diagram showing one example of the electric circuitry for the timepiece shown in FIG. 1.

FIG. 2 shows a block diagram of a preferred embodiment of an electronic timepiece according to the present invention. The electronic timepiece comprises a frequency standard 30 controlled by a quartz crystal 32 to provide a relatively high frequency signal of, for example, 32,768 Hz. This relatively high frequency signal is applied to a frequency converter 34 in the form of a divider which divides down the relatively high frequency signal to produce a low frequency signal $\phi$ as a time unit signal and a low frequency signal $\phi o$ which is higher in frequency than the time unit signal. The low frequency signal $\phi$ is applied through an OR gate 36 to a driver circuit 38 which drives an electro-mechanical transducer 40 such as a stepping motor by which the minutes and hours hands are actuated to indicate time.

The electronic timepiece also comprises a time correction circuit 42 which is controlled by a correction switch 44 associated with the push-button 22 (see FIG. 1) and normally held in a low logic level. The time correction circuit 42 receives at its input terminal A the low frequency signal $\phi o$ of 32 Hz from the frequency converter 34 and generates at its output terminal B a correction signal Ps, which is applied through the OR gate 36 to the driver circuit 38 to perform time correction. The time correction circuit 42 is arranged such that it generates a low speed correction signal Ps composed of a single pulse each time the correction switch 44 is set in a repetitive manner for a short period of time and a high speed correction signal Ps of 32 Hz when the correction switch 44 is set beyond a prescribed period of time. It will thus be possible to cause the minutes and hours hands to advance at a rapid rate until a time instant shortly before the hands of the timepiece have attained the desired correct setting and, thereafter, advance the minutes and hours hands one step at a time. In this manner, the time correction can be performed accurately within a shortened period of time without any difficulty.

Figure 3:
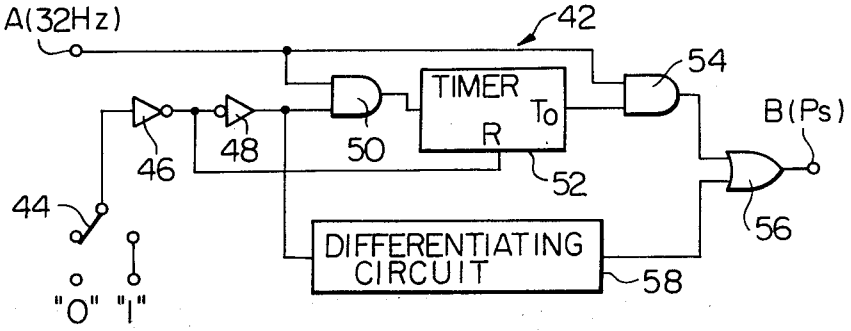
FIG. 3 is a block diagram of a preferred embodiment of a time correction circuit shown in FIG. 2.

FIG. 3 shows one preferred example of the time correction circuit 42 shown in FIG. 2. In FIG. 3, the time correction circuit 42 comprises first and second inverters 46 and 48 connected in series with the correction switch 44. An output of the second inverter 48 is connected to one input of an AND gate 50, whose another input is connected to an input terminal labeled A to receive the 32 Hz signal from the frequency converter. The AND gate 50 has its output connected to an input of a timer 52, whose reset terminal R is connected to an output of the first inverter 46. An output terminal To of the timer 52 is coupled to one input of an AND gate 54, to the other input of which is applied the 32 Hz signal. An output of the AND gate 54 is connected to one input of an OR gate 56 having its output coupled to an output terminal labeled B to apply a correction signal Ps thereto. A single pulse generator composed of a differentiating circuit 58 is connected at its input to the output of the second inverter 48 and connected at its output to another input of the OR gate 56.

As previously noted, since the correction switch 44 is normally held in a low logic level, the output of the first inverter 46 is at a high logic level so that the timer 52 is maintained in its reset condition and, therefore, the output To of the timer 52 remains in a low logic level. Thus, the AND gate 54 is inhibited. At the same time, since the output of the second inverter 48 is at a low logic level, the AND gate 50 is inhibited and the differentiating circuit 58 is rendered inoperative.

When the correction switch 44 is set to a high logic level, the output of the inverter 48 goes to a high logic level. In this instance, the AND gate 50 is opened to pass the 32 Hz signal to the input of the timer 52, and the differentiating circuit 58 generates a single pulse which is applied through the OR gate 56 to the output terminal B. In this case, the correction signal Ps is composed of the single pulse. At the same time, the output of the inverter 46 goes to a low logic level, and the reset condition of the timer 52 is released. Consequently, the timer 52 begins to count the 32 Hz signal gated through the AND gate 50 and the output To goes to a high logic level when the count reaches a predetermined value. This output signal is applied to the AND gate 54, which is consequently opened to pass the 32 Hz signal to the output terminal B through the OR gate 56. Thus, the correction signal Ps is composed of the 32 Hz signal. The correction signal Ps composed of the 32 Hz signal is continuously generated until the correction switch 44 is brought into a low logic level condition and the timer 52 is reset.

It will be noted that when the correction switch 44 is brought into the low logic level condition before the count value of the timer 52 reaches the predetermined count, the timer 52 is forcibly reset and the AND gate 54 is inhibited whereby the correction signal Ps of 32 Hz is not obtained at the output terminal B whereas a single pulse generated by the differentiating circuit 58 is obtained as the correction pulse Ps. Thus, it is possible to perform time correction in a selected mode by controlling a single correction switch.

Figure 4:
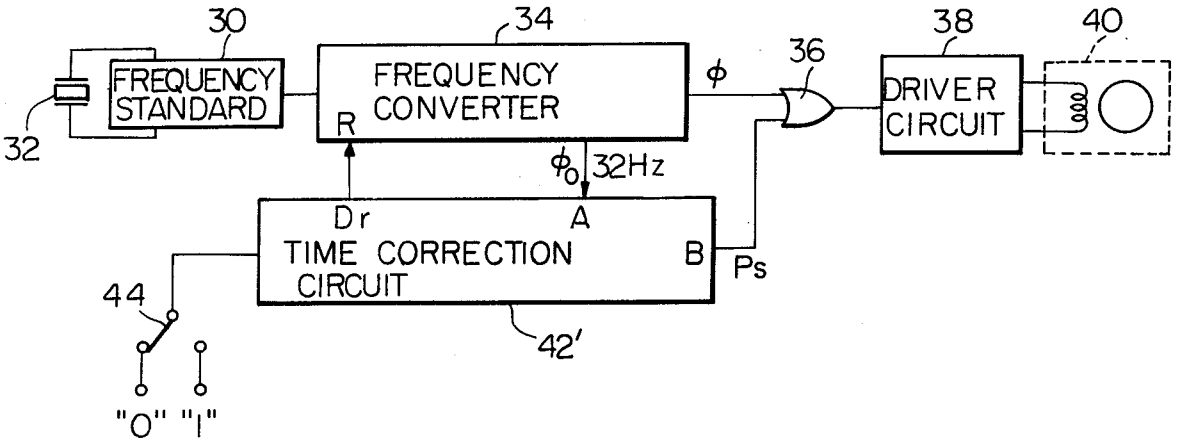
FIG. 4 is a block diagram of a modified form of the electric circuitry shown in FIG. 2.

FIG. 4 shows a block diagram of a modification of the electronic timepiece shown in FIG. 2, with like parts bearing like reference numerals as those used therein. The modification shown in FIG. 4 differs from the embodiment of FIG. 2 in that the time correction circuit 42' generates at its output terminal Dr a reset signal in addition to the correction signal Ps when the correction switch 44 is set to a high logic level at first time for a short period for thereby advancing the stepping motor 40 by one step while resetting the frequency converter 34. When the correction switch 44 is set to the high logic level for a short period at a second time, the reset condition of the frequency converter 34 is released. Thereafter, the one step advancing as well as resetting operation of the frequency converter 34 and the staring operation will be alternately repeated during each setting operation of the correction switch 44. In cases where the correction switch 44 is set to a high logic level for a time interval beyond predetermined value, the time correction circuit 44' generates a correction pulse Ps of 32 Hz at the output terminal B, allowing rapid advancing of the stepping motor 40.

Figure 5:
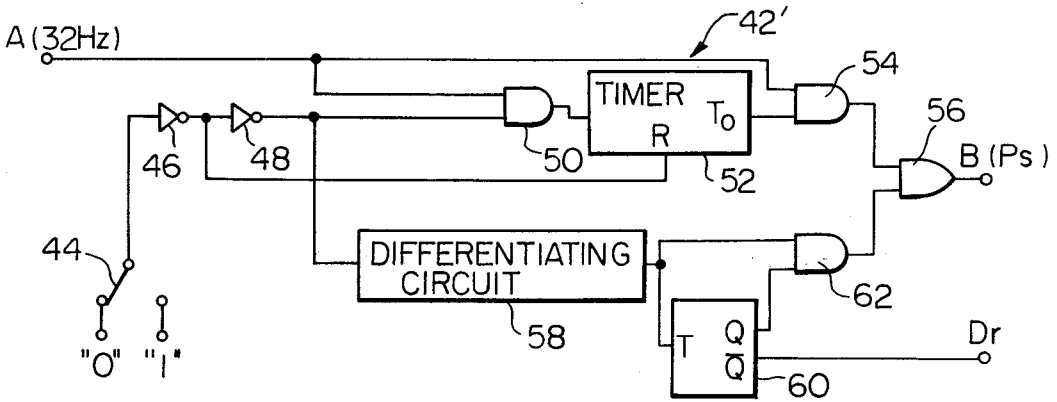
FIG. 5 is a block diagram of one example of a time correction circuit forming part of the circuit of FIG. 4.

FIG. 5 shows a detail circuitry for the time correction circuit 44' shown in FIG. 4, with like parts bearing like reference numerals as those used in FIG. 3. The time correction circuit 42' of FIG. 5 differs from that of FIG. 3 in that it further includes a T-type flip-flop 60 controlled by the output pulse from the differentiating circuit 58, and an AND gate 62 controlled by the Q output of the flip-flop 60. The flip-flop 60 will operate in synchronism with the falling edge of the output pulse from the differentiating circuit 58. The Q output of the flip-flop 60 is applied to one input of the AND gate 62, to the other input of which is applied the output pulse from the differentiating circuit 58. The $\overline{Q}$ output of the flip-flop 60 is applied to a second output terminal labeled Dr, which is connected to to a reset terminal R of the frequency converter 34 to apply a reset signal thereto.

In a state in which the Q output of the flip-flop 60 is at a high logic level and the $\overline{Q}$ output is at a low logic level, if the correction switch 44 is set to a high logic level for a short period in a repetitive manner, an output pulse generated by the differentiating circuit 58 is gated through the AND gate 62 to the first output terminal B via the OR gate 56, and the flip-flop 60 changes state in synchronism with the falling edge of the output pulse. At this instant, the AND gate 62 is inhibited and the $\overline{Q}$ output of high logic level is applied as a reset signal to the output terminal Dr. A second output pulse from the differentiating circuit 58 is inhibited by the AND gate 62, and the flip-flop 60 changes state in synchronism with the falling edge of the second output pulse. Consequently, the AND gate 60 is opened and the reset signal is not generated. These operations will be repeated in response to each output pulse from the differentiating pulse 58. Since the output pulse can be gated through the AND gate 62 as a correction pulse Ps only when the Q output of the flip-flop 60 is at a high logic level, the correction pulse Ps composed of a single output pulse will appear at the output terminal B for only half the setting times of the correction switch 44.

It will thus be seen that, in the modification shown in FIGS. 4 and 5, it is possible to reset the frequency converter 34 while performing the advancement of the stepping motor 40 by one step or in a rapid fashion with the use of a single correction switch 44. Accordingly, if an error exists in the displayed time of the electronic timepiece in an advanced direction, the frequency converter 34 is reset for a desired time interval to stop the operation of the timepiece, and the operation of the frequency converter 34 is started again by setting the correction switch 44 to a high logic level for a short period when the display time coincides with the standard time. In this manner, it is possible to perform time correction either in an advancing side or in a retarded side of the electronic timepiece.

Figure 6:
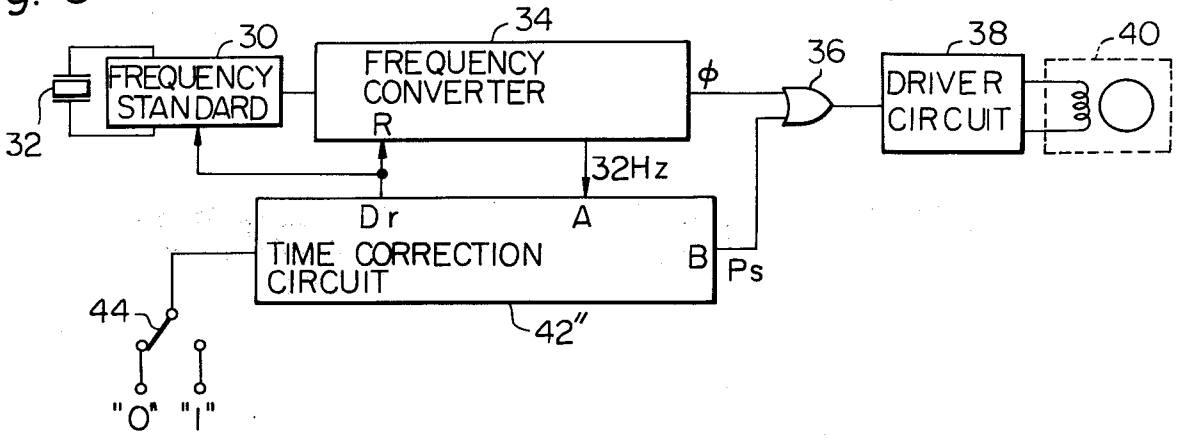
FIG. 6 is a block diagram of another modified form of the electric circuitry of FIG. 2.

FIG. 6 shows a modification of the electronic timepiece shown in FIG. 4. In this modification, the reset signal from the time correction circuit 42" is applied to the frequency standard 30 in addition to the frequency converter 34 whereby these components are reset to halt the operation of the stepping motor 40 to conserve power.

Figure 7:
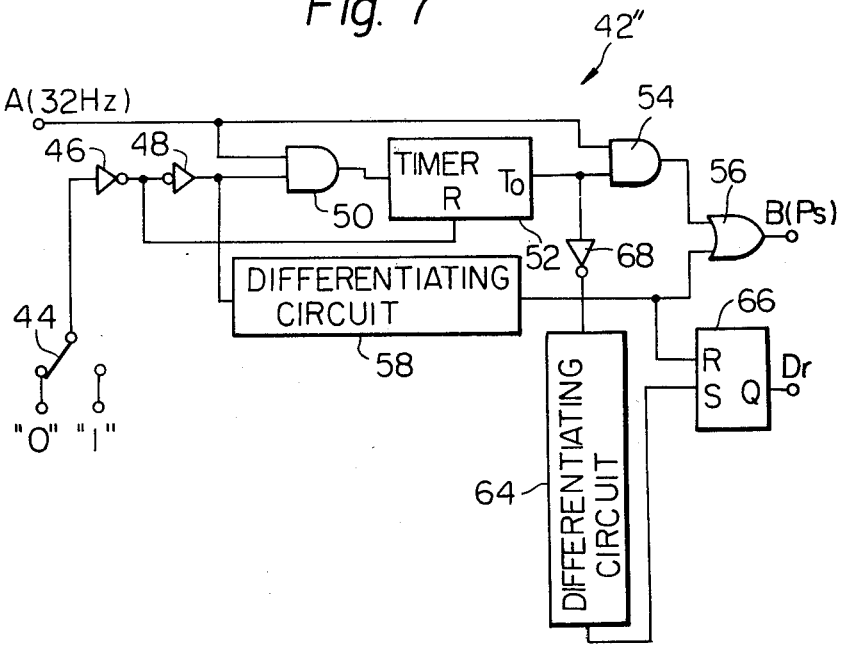
FIG. 7 is a block diagram of one example of a time correction circuit forming part of the electric circuitry of FIG. 6.

A preferred example of the time correction circuit 42" is illustrated in FIG. 7, in which like or corresponding component parts are designated by the same reference numerals as those used in FIG. 3. The time correction circuit 42" of FIG. 7 differs from that of FIG. 3 in that it further includes a second differentiating circuit 64 and an R-S type flip-flop 66. The differentiating circuit 64 is connected at its input to the output terminal To of the timer 52 via an inverter 68, generating a differentiation pulse in response to the output from the timer 52. This differentiation pulse is applied to a set terminal S of the flip-flop 66, whose reset terminal R is connected to the output of the first differentiating circuit 58. The Q output of the flip-flop 66 is connected to the second output terminal Dr of the correction pulse generating circuit 42".

With this arrangement, when the correction switch 44 is set to a high logic level beyond a predetermined time interval the AND gate 50 is opened to pass the 32 Hz signal from the input terminal A to the timer 52. The timer 52 begins to count the 32 Hz signal and, when the count reaches a predetermined value, the timer 52 generates an output. This output is applied to the AND gate 54, which is consequently opened. Accordingly, the 32 Hz signal is gated through the AND gate 54 to the OR gate 56, which generates a correction pulse Ps of 32 Hz. In this case, the stepping motor 40 is rapidly advanced by the correction pulse Ps of 32 Hz. In this condition, if the correction switch 44 is set to a low logic level, the timer 52 is reset and the output To goes to a low logic level. This output is applied through the inverter 68 to the second differentiating circuit 64, which consequently generates a differentiation pulse by which the flip-flop 66 is set. Thus, the Q output of high logic level is applied to the output terminal Dr as a reset signal. This reset signal remains at a high logic level until the flip-flop 66 is reset by the differentiation pulse generated by the first differentiating circuit 58 when the correction switch 44 is set again to a high logic level. Thus, the flip-flop 66 serves as means for generating a reset signal by which the frequency standard 30 and the frequency converter 34 are reset and the power consumption can be reduced. It is to be noted that it may be possible to prevent the output pulse from the first differentiating circuit from being applied to the output terminal B by providing a gate means controlled by the flip-flop 66.

Figure 8:
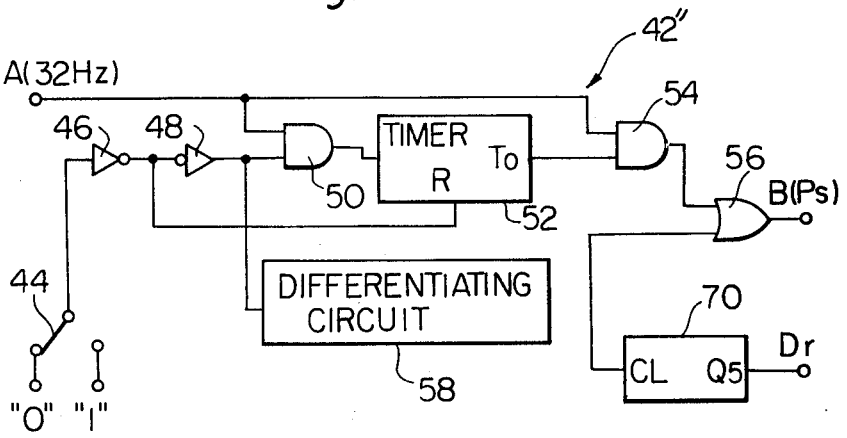
FIG. 8 is a block diagram of another example of the time correction circuit shown in FIG. 6.

FIG. 8 shows another preferred example of the time correction circuit 42" shown in FIG. 6. The time correction circuit 42" of FIG. 8 is similar to that of FIG. 3 except that a count-by-5 ring counter 70 is coupled to the output of the differentiating circuit 58. The ring counter 70 counts the output pulses generated by the differentiating circuit 58 when the correction switch 44 is repetitively set to a high logic level each for a short period and generates an output as a reset signal each for five input pulses applied to the clock input terminal CL. It is thus possible to reset the frequency standard 30 and the frequency converter 34 by manipulating the correction 44 a required number of times for thereby reducing the power consumption and, therefore, there is no need for providing an additional component such as a power switch. When it is desired to start the frequency converter, the correction switch 44 is set to a high logic level for a short period. In this instance, the ring counter 70 is cleared and the reset condition of the frequency standard 30 and the frequency converter 34 is released. While in FIG. 8 the ring counter 70 has been shown as comprising a count-by-5 counter, it should be noted that any other type of ring counter may be used.

Figure 9:
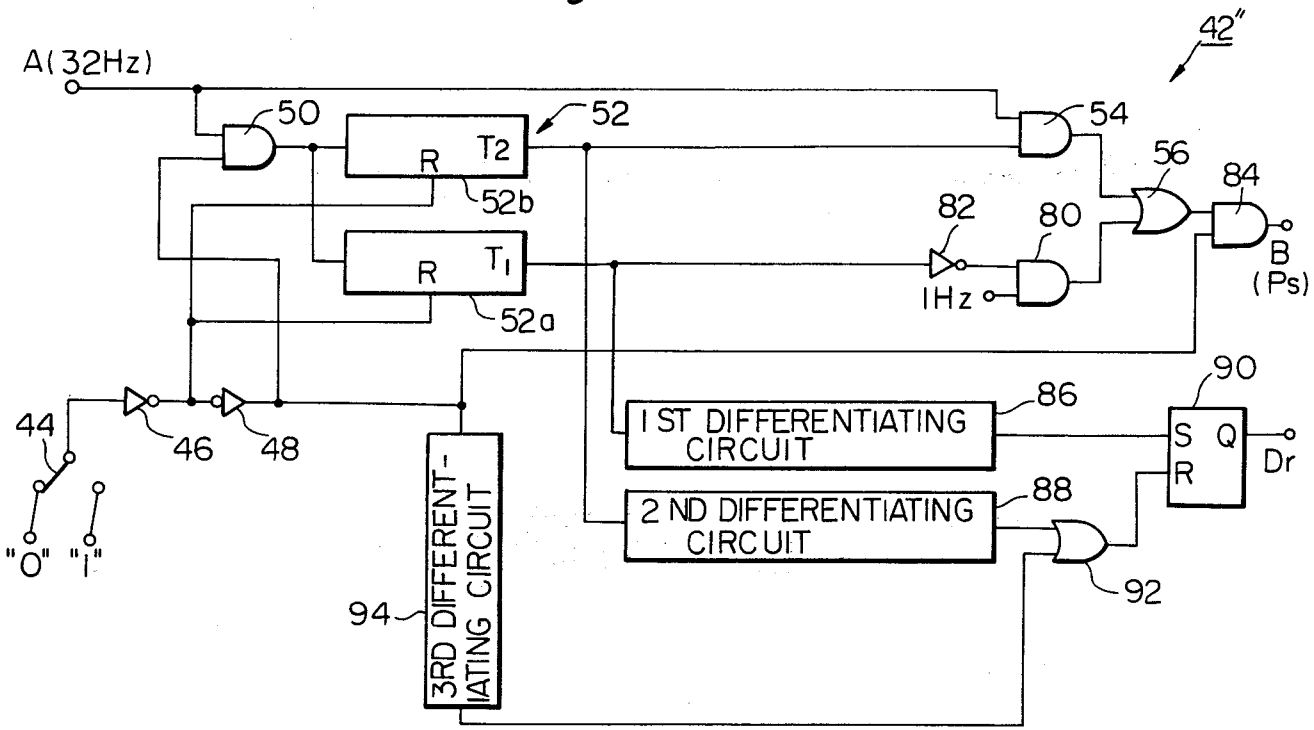
FIG. 9 is a block diagram of another example of the time correction circuit shown in FIG. 6.

FIG.9 shows still another preferred example of the time correction circuit 42", with like parts bearing like reference numerals as those used in FIG. 3. In FIG. 9, the timer 52 comprises first and second timer circuits 52*a* and 52*b* having their inputs coupled to the output of the AND gate 50 and reset terminals connected to the output of the first inverter 46. An output T2 of the second timer circuit 52*b* is connected to one input of the AND gate 54, and an output T1 of the first timer circuit T1 is connected to one input of an AND gate via an inverter 82 to the other input of which is applied a 1 Hz signal from the frequency converter. Thus, the AND gate 54 serves as means for generating high speed correction pulses, while the AND gate 80 serves as means for generating low speed correction pulses as will be clearly described in detail. The outputs of the AND gates 54 and 80 are applied to the OR gate 56, whose output is applied to one input of an AND gate 84 which is controlled by the correction switch 44. An output of the AND gate 84 is connected to the output terminal B. First and second differentiating circuits 86 and 88 are connected to the outputs of the first and second timer circuits 52*a* and 52*b*, respectively, to generate output pulses in response to the outputs therefrom. The output pulse from the first differentiating circuit 86 is applied to a set terminal of an R-S type flip-flop 90, whereas the output pulse from the second differentiating circuit 88 is applied through an OR gate 92 to a reset terminal of the flip-flop 90, to which an output pulse from a third differentiating circuit 94 is also applied through the OR gate 92. The third differentiating circuit 94 is connected at its input to the output of the second inverter 48.

With the arrangement mentioned above, when the correction switch 44 is at a low logic level, the output of the inverter 48 is at a low logic level. In this case, the AND gate 84 is inhibited and, therefore, no correction pulse Ps is supplied to the output terminal B. When, now, the correction switch 44 is set to a high logic level, the output of the inverter 48 goes to a high logic level. Under this condition, the AND gates 50 and 84 are opened and, at the same time, the third differentiating circuit 94 generates an output pulse. This output pulse is applied through the OR gate 92 to the reset terminal of the flip-flop 90 so that the supply of reset signal to the output terminal DR is stopped. Under these circumstances, since the output of the first inverter 46 is at a low logic level, the reset condition of the first and second timer circuits 52*a* and 52*b* are released and, therefore, these timer circuits will count the 32 Hz signal gated through the AND gate 50. In this case, since the output T2 of the second timer circuit 52*b* is at a low logic level, the AND gate 54 is inhibited. On the contrary, since the output of the inverter 82 is at a high logic level, the AND gate 80 is opened to gate the 1 Hz signal therethrough which is applied through the OR gate 84 to the AND gate 84. As previously noted, since the AND gate 84 is opened when the correction switch 44 is set to a high logic level, the 1 Hz signal is applied to the output terminal B as a correction pulse Ps. This correction pulse is applied to the driver circuit 38 so that the stepping motor 40 is driven by one step to allow correction of displayed time at a low speed. When the count in the first timer circuit 52*a* reaches a first predetermined value, the output of the first timer circuit 52*a* goes to a high logic level so that the AND gate 80 is inhibited and 1 Hz signal is not gated through the AND gate 80. At the same time, the first differentiating circuit 86 generates an output pulse by which the flip-flop 90 is set. In this case, the Q output of the flip-flop 90 goes to a high logic level, and is applied as a reset signal to the output terminal DR. Under this condition, if the correction switch 44 is set to a low logic level, the flip-flop 90 is locked and, therefore, the frequency standard 30 and the frequency converter 34 connected to the output terminal DR are reset to conserve the power. If, however, the correction switch 44 remains in its high logic level in a continuous manner, the count value in the second timer circuit 52*b* reaches a second predetermined value so that the output T2 of the second timer circuit 52*b* goes to a high logic level, thereby opening the AND gate 54 while causing the second differentiating circuit 88 to generate an output pulse. This output pulse is gated through the OR gate 92 and applied to the reset terminal of the flip-flop 90, which is consequently reset. Therefore, the reset conditions of the frequency standard and the frequency converter are released and, at the same time, the 32 Hz signal is applied to the output terminal B as a high speed correction pulse Ps through the gates 54, 56 and 84.

It will thus be seen that the time correction circuit of FIG. 9 makes it possible to perform low speed and high speed correction of displayed time and obtain power saving condition.

Figure 10:
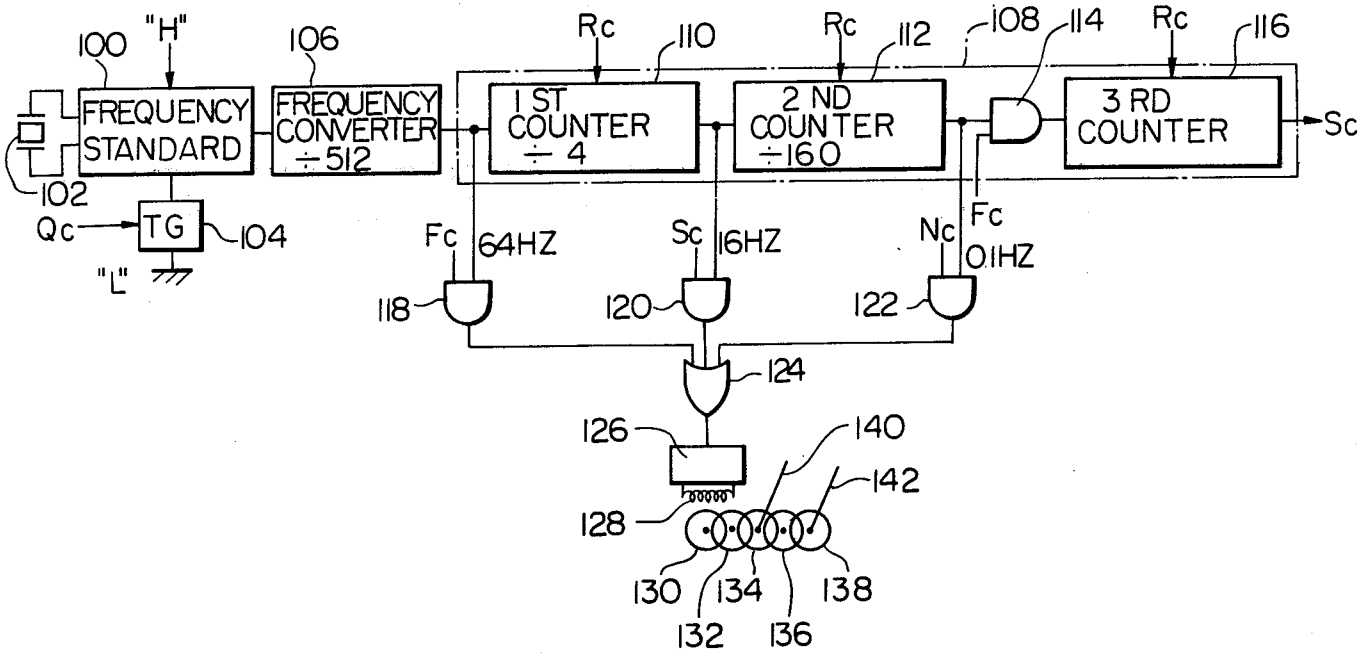
FIG. 10 is a block diagram showing another example of the electric circuitry for the timepiece shown in FIG. 1.

FIG. 10 shows a block diagram of a modified form of the electronic timepiece shown in FIG. 2. In FIG. 10, the electronic timepiece comprises a frequency standard 100 controlled by a quartz crystal 102 to provide a relatively high frequency signal of, for example, 32,768 Hz. The frequency standard 100 may comprise an oscillator circuit, to which a switching device 104 composed of a transmission gate is coupled to selectively cut off the power applied to the oscillator circuit in response to an input signal Q which will be described in detail hereinafter. The electronic timepiece further comprises a frequency converter 106 connected to the frequency standard 100 to receive the relatively high frequency signal therefrom. The frequency converter 106 divides down the relatively high frequency signal from the frequency standard by 512 to provide a first low frequency signal of 64 Hz which will be utilized for generating a high speed correction pulse of 64 Hz as will be described later. The 64 Hz signal is applied to a time counter 108 composed of a first counter 110, a second counter 112, an AND gate 114 and a third counter 116 composed of three flip-flops and serving as a count-by-8 counter. The 64 Hz signal is divided by 4 in the first counter 110 to produce a second low frequency signal of 16 Hz which will be used for generating a low speed correction pulse of 16 Hz. The 16 Hz signal is divided by 160 in the second counter 112 to produce a third low frequency signal of 0.1 Hz which will be used for normal driving of the timepiece. The AND gate 114 is opened in response to an input signal Fc serving as a high speed correction selector signal, thereby interconnecting the third counter 116 with the second counter 112 in series to constitute the count-by-5120 counter 108 which will be described in detail hereinafter. The first, second and third counters 110, 112 and 116 are arranged to be concurrently reset by a reset signal Rc which will be subsequently described.

As shown in FIG. 10, the first, second and third low frequency signals are applied to first, second and third AND gates 118, 120 and 122, respectively, which serve as a selector circuit means. The first AND gate 118 is opened in response to an input signal Fc, gating the 64 Hz signal therethrough. The second AND gate 120 is opened in response to an input signal Sc, gating the 16 Hz signal therethrough. The third AND gate 122 is opened in response to an input signal Nc, gating the 0.1 Hz signal therethrough. Outputs from the AND gates 118, 120 and 122 are gated through an OR gate 124 to a driver circuit 126, which energizes a driving coil 128 of a stepping motor to drive a rotor 130. The rotor 130 engages with a gear wheel 132, which rotates a minutes wheel 134 at a reduced speed. Indicated as 136 is a minutes wheel pinion which is connected to the minutes wheel 134 and rotates an hours wheel 138. A minutes hand 140 is connected to the minutes wheel 134, and an hours hand 142 is connected to the hours wheel 138. During high speed time correction at the rate of 64 Hz, the minutes hand 140 is caused to rotate at a speed about ten times that of a conventional seconds hand. The hours hand 142 is rotated for one revolution within about 67.5 seconds and, therefore, it is possible to set the minutes and hours hands to desired setting within such period. During low speed time correction at the rate of 16 Hz, the minutes hand 140 is caused to rotate at a speed 2.67 times that of the conventional seconds hand.

The counter 108 serves to count 5120 pulses contained in the output signal from the frequency converter 106, thereby generating an output signal Sc at a high logic level. The output signal Sc is converted to a signal Qc for cutting off the transmission gate 104 in a manner as will be described in detail hereinafter. In the timepiece shown in FIG. 10, the minutes hand 140 will complete its one revolution by one pulse. During the time interval in which the high speed time correction is continuously performed after the counter 108 has been reset, the 64 Hz signal is applied to the counter 108. When the minutes hand 140 is rotated through 5120 revolutions, the supply of output signal from the frequency standard 100 is stopped whereby the minutes and hours hands 140 and 142 are halted. One cycle of the hours hand 142, i.e., 12 hours correspond to 4320 ($6\times60\times12$) revolutions of the minutes hand 140 and, therefore, the 5120 revolutions of the minutes hand 140 correspond to 14 hours and 13 minutes. Thus, a range in which the time correction can be performed covers 12 hours. The time required for halting the oscillation of the frequency standard is 80 seconds ($5120\div64$ Hz).

While the counter 108 has been described as the type which counts 5120, it should be noted that the counter 108 may be of the type which counts 360. In this case, the minutes hand 140 will be stopped after it has been advanced by a value corresponding to one hour and, thus, a difference in time can also be corrected. The stepping motor may be of the reversible type so that the minutes hand 140 can be rotated in the reverse or counterclockwise direction.

Figure 11:
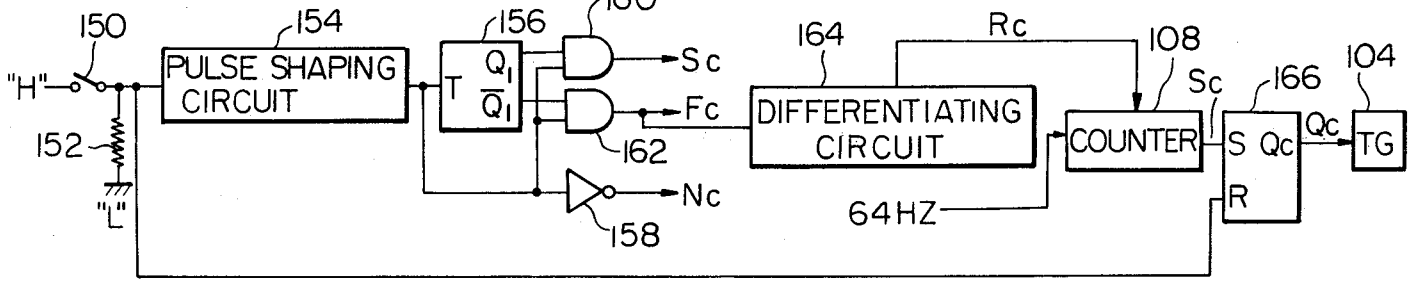
FIG. 11 is a block diagram of a preferred embodiment of a time correction circuit forming part of the circuit of FIG. 10.

FIG. 11 shows a preferred example of a time correction circuit for the electronic timepiece shown in FIG. 10. The time correction circuit comprises a correction switch 150 associated with the push-button 22 shown in FIG. 1 and normally held in an open condition. The reference numeral 152 indicates a resister which is connected to a low logic level or ground. Connected to the correction switch 150 is a pulse shaping circuit 154, which generates an output signal when the correction switch 150 is closed. The output signal from the pulse shaping circuit 154 is applied to a T-type flip-flop 156 and an inverter 158. The Q1 and Q1 outputs of the flip-flop 156 are applied to AND gates 160 and 162, to which the output signal from the pulse shaping circuit 154 is also applied. The inverter 158 generates a signal Nc when the correction switch 150 is held in its open condition, i.e., when the output signal from the pulse shaping circuit 154 is at a low logic level. This signal Nc is applied to the AND gate 122, gating the 0.1 Hz signal therethrough to the OR gate 124 so that the driver 126 drives the stepping motor in a normal operating mode (see FIG. 10). The AND gate 160 generates a signal Sc when the output signal from the pulse shaping circuit 154 and the Q1 output are at a high logic level. The signal Sc is used for selecting a low speed correction pulse and applied to the AND gate 120 shown in FIG. 10. The AND gate 162 generates a signal Fc when the output signal from the pulse shaping circuit 154 and the Q1 output are at a high logic level. The signal Fc is used for selecting a high speed correction pulse and applied to the AND gate 118 shown in FIG. 10. With this arrangement, the high speed or low speed time correction mode is selected each time the push-button is depressed. When the push-button remains depressed, the timepiece is maintained in a selected time correction mode, whereas when the push-button is released the timepiece is returned to the normal run mode.

The signal F is applied to a differentiating circuit 164, which generates a reset signal Rc instantaneously when the high speed correction mode begins in response to the signal Fc. The reset signal Rc is applied to the reset terminal of the counter 108, which is consequently reset. The high speed correction pulse of 64 Hz is applied to the counter 108, which counts the 5120 pulses to generate an output Sc. The output Sc is applied to a set terminal of an R-S type flip-flop 166, which is consequently set and the Qc output goes to a high level. In this instance, the transmission gate 104 is turned off so that the power applied to the frequency standard 100 (see FIG. 10) is cut off. This state will be continued even when the push-button is released, shutting off the frequency standard to conserve the power. When it is required to start the timepiece, the correction switch 150 is depressed and the flip-flop 166 is reset so that the Qc output goes to a low logic level, turning on the transmission gate 104 by which the frequency standard 100 begins to operate.

In a case where the output signal from the frequency standard 100 has a frequency of 32,768 Hz, it takes 80 seconds before the operation of the frequency standard 100 will be halted. This time interval will present no problem for the timepiece users or in the market. However, the time interval seems to be too long especially in a case where the timepiece is tested in the manufacturer. This can be solved by applying a high frequency testing signal to the frequency divider. For example, the checking of shutting off of the frequency standard 100 can be completed within 0.156 seconds by applying a testing pulse of 8,192 Hz to the AND gate 118 instead of applying the 64 Hz signal thereto.

Figure 12:
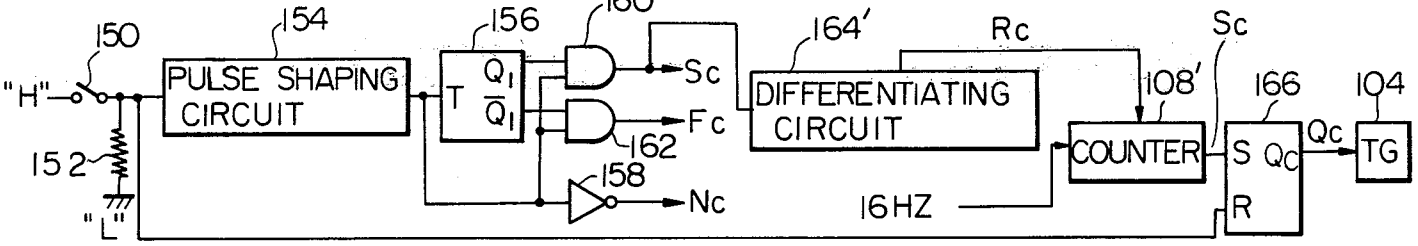
FIG. 12 is a block diagram of a modified form of the time correction circuit of FIG. 11.

FIG. 12 shows a modification of the time correction circuit of FIG. 11, with like parts bearing like reference numerals as those used in FIG. 11. In FIG. 12, the time correction circuit includes a count-by-640 counter 108', to a reset terminal of which is applied a reset signal R'c generated by a differentiating circuit 164' instantaneously when the signal Sc is generated and the low speed time correction mode begins. The counter 108' is supplied with the low speed time correction pulse of 16 Hz and counts 640 pulses to generate a signal Sc for shutting off the frequency standard. The counter 116 may comprise a count-by-4 counter. In this case, the minutes hand is rotated through 640 revolutions between the starting of the low speed time correction and the shutting off of the frequency standard, corresponding to 1 hour and 51 minutes. Thus, a time corrective range sufficiently covers 1 hour required for the low speed time correction. Also, the shutting off of the frequency standard can be achieved at 40 (640÷16 Hz) seconds after the low speed time correction mode has been started.

It will now be understood that since the timepiece shown in FIG. 10 makes it possible to selectively perform high speed and low speed time correction by sequentially operating the correction switch the time can be accurately set within the shortest period of time. Since, further, the shutting off of the frequency standard is completed at a predetermined time instant beyond a range in which the time can be corrected by the wearer, the mulfunction of the timepiece can be prevented in the normal timekeeping mode. Since, moreover, the time-indicating hands will be halted when the shutting off of the frequency standard is achieved, the distinction of the shutting off of the frequency standard can be readily obtained. The power can be remarkably conserved by shutting off the frequency standard while the timepiece is not in use. The operation of the frequency standard can be easily started merely by depressing the push-button as previously noted.

Figure 13:
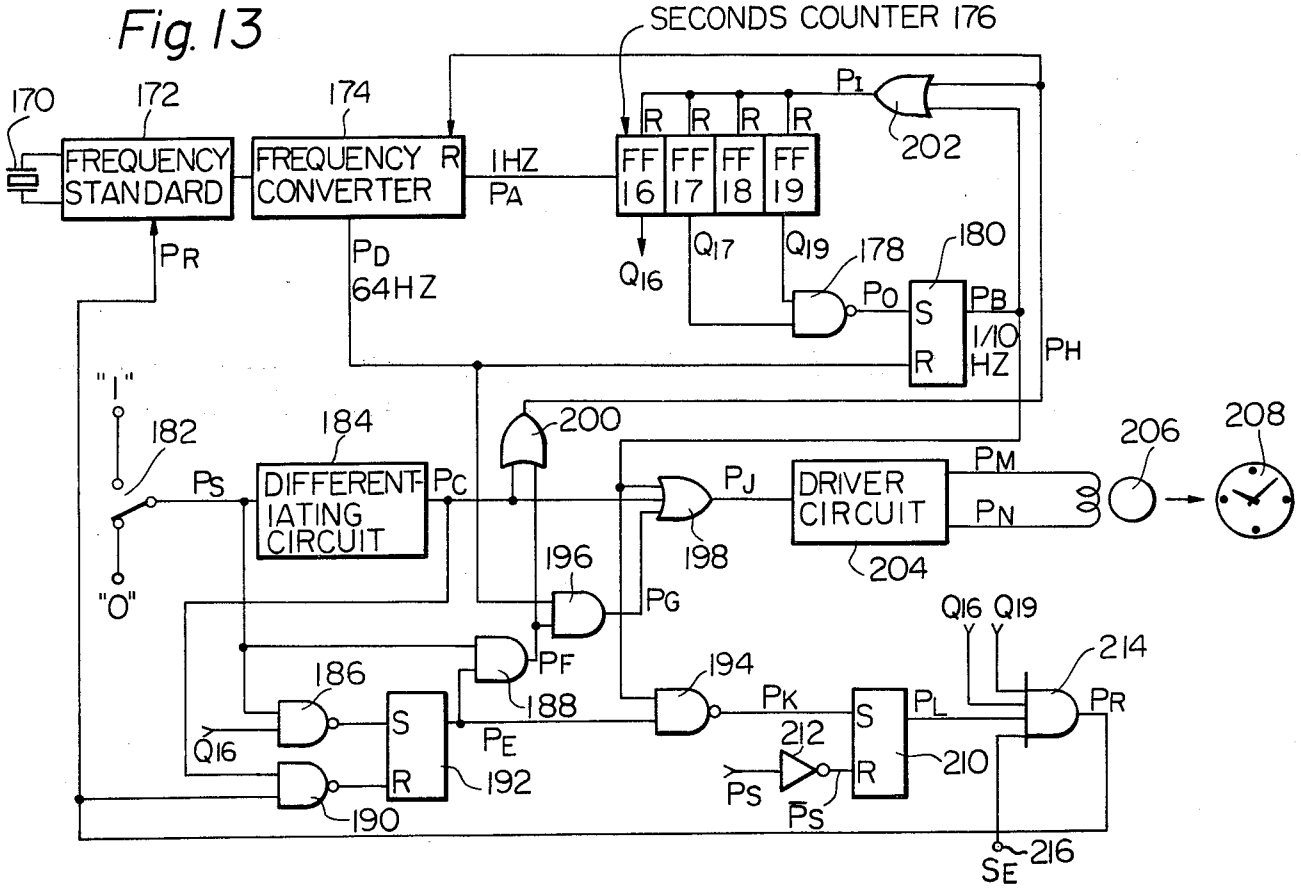
FIG. 13 is a block diagram showing still another example of the electric circuitry for the timepiece shown in FIG. 1.

FIG. 13 shows a block diagram of an electronic timepiece incorporating a time correction circuit according to the present invention. In FIG. 13, the reference numeral 170 designates a quartz crystal which controls a frequency standard 172 which produces a relatively high frequency signal of 32,768 Hz. This relatively high frequency signal is applied to a frequency converter 174 formed by flip-flops by which the high frequency signal is divided down to provide a signal PD at 64 Hz and a signal PA at 1 Hz. The 1 Hz signal PA is applied to a seconds counter 176 composed of flip-flops FF16 to FF19. The Q17 and Q19 outputs of the flip-flops FF17 and FF19 are applied to a NAND gate 178 which produces an output PO, which is applied to a set terminal of an R-S type flip-flop 180. The flip-flop 180 has a reset terminal connected to an intermediate stage of the frequency converter 174 to receive the 64 Hz signal therefrom and generates an output signal PB at 1/10 Hz.

Indicated as 182 is a correction switch which is associated with the pushbutton 22 shown in FIG. 1 and normally held at a low logic level. When the correction switch 182 is set to a high logic level, a set signal PS is generated and applied to a differentiating circuit 184, one input of a NAND gate 186, and one input of an AND gate 188. The differentiating circuit 184 generates a single correction pulse PC in response to the set signal PS. The correction pulse PC is applied to one input of a NAND gate 190, to the other input of which is applied a reset signal PR which is also applied to the frequency standard 172. The NAND gate 186 is also applied with the Q16 output of the flip-flop FF16 of the seconds counter 176, generating an output which is applied to a set terminal of an R-S type flip-flop 192 whose reset terminal is connected to an output of the NAND gate 190. The flip-flop 192 generates an output PE, which is applied to the AND gate 188 and a NAND gate 194. The AND gate 188 generates an output PF in response to the set signal PS and the output PE. The output PF is applied to one input of an AND gate 196, to the other input of which is applied the 64 Hz signal PD from the frequency converter 174 to generate a high speed correction signal PG. The high speed correction signal PG is applied to an OR gate 198. The output PF is also applied to one input of an OR gate 200, to the other input of which is applied the correction pulse PC. The OR gate 200 generates a reset signal PH, which is applied to one input of an OR gate 202 to the other input of which is applied the output signal PB of 1/10 Hz generated by the flip-flop 180. Thus, the OR gate 202 generates a reset signal PI, which is applied to reset terminals of the flip-flops FF16 to FF19 of the seconds counter 176. The reset signal PH is also applied to a reset terminal of the frequency converter 174 to reset a part thereof. The OR gate 198 responds to the output signal PB of 1/10 Hz, the correction pulse PC and the high speed correction signal PG, generating an output PJ which is applied to a driver circuit 204. The driver circuit 204 generates drive signals PM and PN, which are applied to a stepping motor 206 to drive time-indicating members 208.

The NAND gate 194 responds to the output signals PB and PE, generating an output PK which is applied to a set terminal of an R-S type flip-flop 210. A reset terminal of the flip-flop 210 is connected to an output of an inverter 212 to receive a signal PS which is the inverse of the set signal PS. The flip-flop 210 serves as a memory circuit to store the output signal PB of 1/10 Hz and generates an output PL, which is applied to an AND gate 214 to which the Q16 and Q19 outputs of the seconds counter 176 and an input signal SE appearing at an external terminal 216 are also applied to generate a reset signal PR. When it is desired to shut off the frequency standard 172, the external terminal 216 is coupled to a high logic level. The reset signal PR is applied to the frequency standard 172 and the NAND gate 190.

In normal operation, the relatively high frequency signal of 32,768 Hz is applied to the frequency converter 174. The frequency converter 174 divides down the high frequency signal to provide a low frequency signal PA of 1 Hz, which is applied to the seconds counter 176 whose Q17 and Q19 outputs are coupled to the NAND gate 178. When both of the Q17 and Q19 outputs go to a high level, the output PO of the NAND gate 178 goes to a low level. Since the flip-flop 180 is of the negative going edge triggered type, the output PB goes to a high level when the output PO goes to a low level. The output PB is applied to the OR gate 202, which generates a reset signal PI by which the seconds counter 176 is reset. Thus, the output PO of the NAND gate 178 goes to a high logic level. However, since the flip-flop 180 stores a logic "1" state, the output PB remains at a high logic level until the output signal PD of 64 Hz goes to a low logic level. Consequently, the time interval in which the output PB remains at a high logic level corresponds to a half cycle of the output signal PD of 64 Hz, i.e., about 7.8 milliseconds. Since both of the Q17 and Q19 outputs go to a high logic level once per ten seconds, the frequency of the output signal PB is 1/10 Hz and the seconds counter 176 serves as a count-by-ten counter. The 1/10 Hz signal PB is applied through the OR gate 198 to the driver circuit 204, which generates drive signals PM and PN at the cycle of ten seconds. Thus, the stepping motor 206 advances the time-indicating members 208 by ten seconds.

If, now, the correction switch 182 is set to a high logic lever, the set signal PS goes to a high logic level. Therefore, the differentiating circuit 184 generates correction pulse PC, which is applied through the OR gate 198 to the driver circuit 204. In this instance, the driver circuit 204 generates a drive signal to drive the stepping motor 206 by one step. The driver circuit 204 generates the drive signal PM or PN each time the correction switch 182 is set a high logic level and therefore, the time-indicating members 208 are advanced by one step in a repetitive fashion. In this manner, the time correction can be performed at a low speed in response to the depression of the push button associated with the correction switch 182.

The high speed time correction can be performed in a manner to be described below. When the correction switch 182 is set to a high level, the correction pulse PC is generated by the differentiating circuit 184 as previously noted. The correction pulse PC is applied through the OR gate 198 to the driver circuit 204 to advance the stepping motor 206 by one step. At the same time, the correction pulse PC is applied through the OR gates 200 and 202 to the reset terminals of the seconds counter 176 and applies to the reset terminal of the frequency converter 174. Thus, the frequency converter 174 and the seconds counter 176 are reset to "0" for a short period and, thereafter, the seconds counter 176 begins to count from zero. When one second has passed after the correction switch 182 is set to the high level, the Q16 output of the first stage of the seconds counter 176 goes to a high logic level. Consequently, if the correction switch 182 remains at a high logic level, the output of the NAND gate 186 goes to a low logic level. In this instance, the flip-flop 192 is set and the output PE goes to a high logic level. Accordingly, the AND gate 188 generates an output PF by which the AND gate 196 is opened to generate a high speed correction signal PG of 64 Hz. This signal is applied through the OR gate 198 to the driver circuit 204 so that the stepping motor 206 drives the time-indicating members 208 at a high speed for time correction.

In order to stop the high speed correction mode, the correction switch 182 is set to a low logic level. In this case, the AND gate 188 is inhibited and the output PF goes to a low logic level, thereby inhibiting the AND gate 196 so that the time-indicating members 208 will stop.

During the high speed correction mode, the output PF of the AND gate 188 is applied through the OR gates 200 and 202 to the frequency converter 174 and the seconds counter 176 as a reset signal. Consequently, a portion of the frequency converter 174 and the seconds counter 176 are maintained in a reset condition when the high speed correction mode is selected.

It will thus be seen that when the correction switch 182 is set to a high logic level for one second in a repetitive manner, the time-indicating members 208 will be advanced by one step in the repetitive manner whereas when the correction switch remains at a high logic level for more than one second the stepping motor will be advanced at a high speed, i.e. at 64 Hz whereby the time correction of one hour can be completed within about six seconds.

The shutting off of the frequency standard 172 to conserve power will not be described in detail below.

When the stepping motor is driven in the high speed correction mode by holding the correction switch 182 to a high logic level for more than one second, the output PE of the flip-flop 192 is at a high logic level as previously noted. The output PE remains at a high logic level even when the high speed correction mode is stopped. As previously described, the seconds counter 176 is maintained in the reset condition in the high speed correction mode. However, when the high speed correction mode is stopped, the second counter 176 begins to count from zero, and the flip-flop 180 generates an output PB after ten seconds. Since, in this instance, the output PE of the flip-flop 192 is at a high logic level, the NAND gate 194 generates an output PK in response to the output PB. This output PK is applied to the flip-flop 210, which is consequently set. Thus, the output PL goes to a high level after ten seconds from the releasing of the push-button associated with the correction switch 182. This output PL is applied to the AND gate 214, to which the Q16 and Q19 outputs of the seconds counter 176 and the input signal SE are also applied. Both of the Q16 and Q19 outputs go to a high level when the count in the seconds counter reaches a count of 9. Consequently, if the external terminal is coupled to the high logic level and the input signal is at the high level, the AND gate 214 generates an output PR after 19 seconds from the time instant at which the high speed correction mode has been stopped. The output PR is applied to the NAND gate 190 which resets the flip-flop 192, and also applied to the frequency standard 172 to shut off the oscillator circuit forming the frequency standard whereby whole circuits are brought into "hold" condition. The power consumption in this "hold" condition is less than 0.1 $\mu$A and, thus, the power can be remarkably conserved. In the "hold" condition, the states of the flip-flops FF16 to FF19 of the seconds counter 176 are expressed by "1", "0", "0", "1" corresponding to the count "9", while the output PE of the flip-flop 192 is at a low logic level.

When it is desired to start the operation of the timepiece, the correction switch 182 is set to a high level once so that the set signal PS goes to a high logic level. In this case, the output PS of the inverter 212 goes to a low logic level, resetting the flip-flop 210. At this instant, the output PL goes to a low logic level, inhibiting the AND gate 214. Thus, the output PR goes to a low logic level so that the reset condition of the frequency standard 172 is released. In this case, the frequency standard 172 begins to supply a relatively high frequency signal to the frequency converter 174, from which a low frequency signal of 1 Hz is applied to the seconds counter 176. Since, in this instance, the seconds counter 176 has been maintained in its "hold" condition at the count of "9", the seconds counter 176 will be cleared at zero after one second from the starting operation of the frequency standard 172. At this instant, the flip-flop 180 generates an ouput PB, which is applied through the OR gate 198 to the driver circuit 204. The driver circuit 204 generates one pulse drive signal by which the stepping motor 206 is advanced by one step. Thereafter, the timepiece will operate in its normal run mode. It will thus be seen that the wearer can readily identify whether the oscillation is normally started by watching the one step advancement of the minutes hand after depressing the push button associated with the correction switch.

When it is undesired to reset the frequency standard 172, the correction switch 182 is set to the high level again within 19 seconds after the high speed time correction has been completed. In this case, the differentiating circuit 184 generates a correction pulse PC, which is applied to the NAND gate 190 by which the flip-flop 192 is reset and the output PE goes to a low level. Consequently, the output PK of the NAND gate 194 is held at a high logic level so that the flip-flop 210 is prevented from being set. On the other hand, since the output PS of the inverter 212 goes to a low logic level when the correction switch 182 is set to a high logic level, the flip-flop 210 is reset and the output PL goes to a low logic level whereby the AND gate 214 is inhibited. Therefore, the output PR of the AND gate 214 is maintained at a low logic level so that the frequency standard 172 is not reset and the timepiece will operate in its normal run mode.

As previously noted, the reset function of the frequency standard 172 is selected by applying the high level input signal SE to the external terminal 216, whereas when the input signal SE is at a low logic level the frequency standard 172 is prevented from being reset. Therefore, it is possible to manufacture an electronic timepiece with the use of a single integrated circuit chip in which the shutting off of the frequency standard can be obtained by applying a high level input signal to the external terminal.

Figure 14:
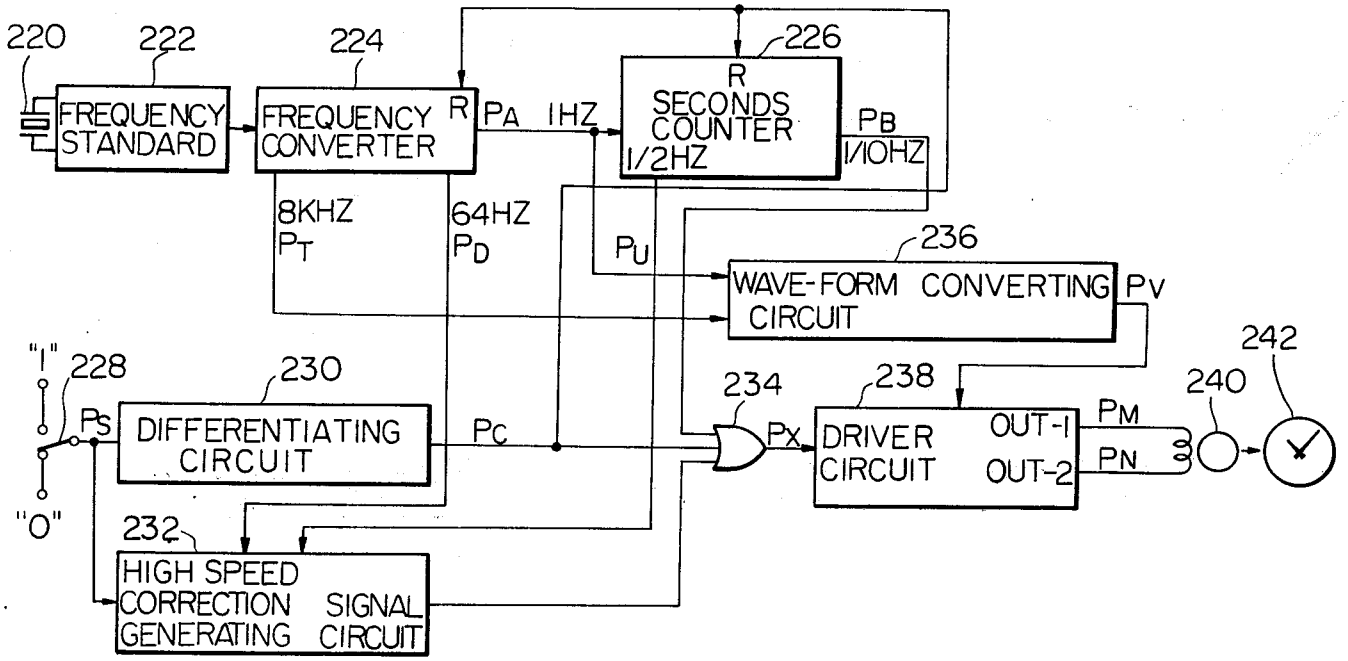
FIG. 14 is a block diagram showing still another example of the electric circuitry for the timepiece shown in FIG. 1.

FIG. 14 is a block diagram of a modified form of the electronic timepiece shown in FIG. 13. Reference numeral 220 denotes a quartz crystal having a frequency of 32,768 KHz, 222 a frequency standard, 224 a frequency converter for dividing down the signal obtained from the frequency standard 222 to provide a 1 Hz signal PA 226 a seconds counter for producing a 1/10 Hz signal PB, 228 a correction switch associated with the push-button mentioned above, and 230 a differentiating circuit which produces a correction pulse PC upon differentiating a set signal PS obtained from the correction switch 228. Reference numeral 232 denotes a high speed correction signal generating circuit which produces a 64 Hz correction signal PW upon receipt of the set signal PS as provided by the correction switch 228, the 64 Hz output signal PD as provided by the frequency converter 224, and a ½ Hz output signal PU as provided by the seconds counter 226. An OR gate 234 provides the logical sum of output signal PB from the seconds counter 226, correction pulse PC as obtained from the differentiating circuit 230, and correction signal PW produced by the correction signal generating circuit 232. Reference numeral 236 denotes a waveform converting circuit which produces an advance degree measurement signal PV having a period of one second upon receipt of the 1 Hz output signal PA and a 8192 Hz output signal PT as obtained from the frequency converter 224. Reference numeral 238 denotes a driver circuit which, upon receipt of an output signal PX from the OR gate 234 and the advance degree measurement signal PV from the wave-form converting circuit 236, produces driving signals PM and PN which appear at respective output terminals OUT-1 and OUT-2. Finally, reference numeral 240 denotes a stepping motor and 242 a time indicating means comprising a wheel train driven by the stepping motor 240 as well as hours and minutes hands connected to the wheel train.

The normal operation of this circuit is as follows. The 32,768 KHz signal produced by the frequency standard 222 is divided down to a 1/10 Hz signal PB by means of the frequency converter 224 and seconds counter 226. The 1/10 Hz signal PB is gated through the OR gate 234 and applied to the driver circuit 238 which in turn produces a ten second driving signal supplied to the stepping motor 240. As a result, the time indicating means 242 which is connected to the motor is advanced by 10 seconds. This is the normal state of operation when the correction switch 228 is held at a low logic level. To perform a time correction, the switch 228 is actuated thus raising the set signal PS to high logic level whereupon the differentiating circuit 230 produces a single correction pulse PC which is gated through the OR gate 234 and applied to the driver circuit 238 thereby driving the stepping motor 240 through one step. The stepping motor 240 is thus driven by the correction pulses PC produced by the differentiating circuit 230, the number of these pulses conforming to the number of times the correction switch 228 is manipulated. However, since the hands of the timepiece are advanced by 10 seconds as previously described, each single manipulation of the correction switch 228 enables a low speed correction to be accomplished in which the minutes hand is advanced by only 10 seconds.

Since the low speed correction as described above would require a large amount of time in order to perform a major timepiece correction, the present invention also includes circuitry for advancing the stepping motor at a high rate when major corrections are required. Namely, the high speed correction signal generating circuit 233, as hereinbefore described, is supplied by the correction switch with the set signal PS, the 64 Hz signal PD from the frequency converter 224, and the ½ Hz signal PU as obtained from the seconds counter 226. When the set signal PS and ½ Hz signal PU both attain a high logic level, the 64 Hz signal is passed and a high speed correction signal PW produced. Thus if the correction switch 228 is manipulated so as to raise the set signal PS to a high logic level and produce a correction pulse PC, the pulse advances the stepping motor through one step and is supplied to the reset terminals R of the frequency converter 224 and seconds counter 226 the contents of which assume a low logic level for a short period of time, the counter thus once again beginning to count from zero. One second after manipulation of the switch 228 has begun, the ½ Hz signal PU from the seconds counter 226 attains a high logic level. When the set signal PS is held at a high logic level by keeping the switch 228 depressed, one second thereafter the high speed correction signal generating circuit 232 produces a 64 Hz correction signal PW which is gated through the OR gate 234 and applied to the driver circuit 238 so as to advance the stepping motor 240 at a high speed. In other words, a high speed correction can be achieved in this case by keeping the switch 228 depressed for more than one second; depressing the switch for 6 seconds enables one hour time correction to be accomplished.

The wave-form converting circuit 236 is supplied with a 8192 Hz signal PT as provided by the 3rd stage flip-flop of the frequency converter 224, and an output signal PA as provided by the last stage whereby the wave-form converting circuit produces an advance degree measurement signal PV having a period of 1 Hz and a pulse width of 120 μSec which is applied to the driver circuit 238.

Figure 15:
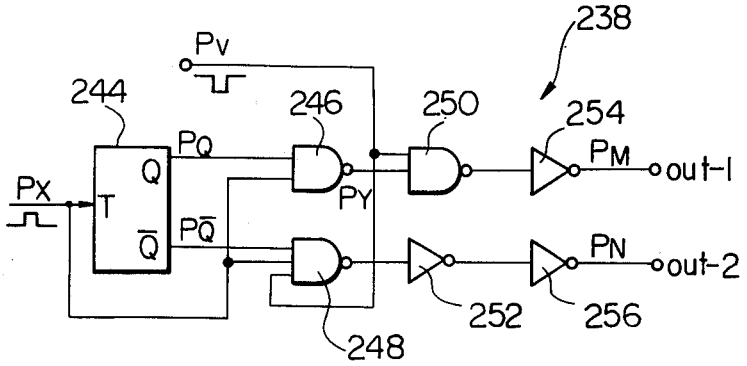
FIG. 15 is a detail block diagram of a driver circuit shown in FIG. 14.

A more detailed description of driver circuit 238 will now be made with reference to FIG. 15. The driver circuit 238 comprises a flip-flop (hereinafter referred to as FF 244) which, upon receipt of the output signal PX as provided by the OR gate 234, produces signals PQ and PQ which are reduced in frequency by ½. Reference numeral 246 denotes a NAND gate provided with input signals PX and PQ which is obtained from the FF 244, reference numeral 248 denotes a NAND gate provided with signals PX, PQ and advance degree measurement signal PV as inputs, reference numeral 250 denotes a NAND gate provided with the advance degree measurement signal PV and a signal PY produced by the NAND gate 246, refernce numeral 252 denotes an inverter, and reference numerals 254 and 256 denote buffers which produce driving signals PM and PN as obtained from output terminals OUT-1 and OUT-2.

With output signal PX as obtained from the OR gate 234 applied as a positive signal to input terminal T of FF 244 and the inputs of the NAND gates 246 and 248, the NAND gate 246 provided with PQ as an input signal passes signal PI so that a driving signal PM appears at the output terminal OUT-1 when the output signals PQ and PQ provided by the FF 244 are at high and low logic levels, respectively. When the output signal PX falls, the output signals produced by FF 244 reverse with PQ attaining a low logic level and PQ a high logic level. When the output signal PX is again applied as a positive going pulse to FF 244, as well as NAND gate 246 and 248, the NAND gate 22 passes signal PX so that a driving signal PN appears at the output terminal OUT-2. Driving signals PM and PN thus alternatingly appear at ten second intervals at the output terminals OUT-1 and OUT-2.

With the advance degree measurement signal PV applied as a negative pulse to the inputs of the NAND gate 248 and 250, the advance degree measurement signal PV applied to the NAND gate 248 functions to close the gate for a period equal to the pulse width of PV, i.e., for 120 μSec, while the advance degree measurement signal PV applied to the NAND gate 250 is logically added with the output signal PY obtained from the NAND gate 246 whereby output signal PM appears at the output terminal OUT-1. Accordingly, the output signal PM is obtained from the output terminal OUT-1 as the driving signal, from which the advance degree measurement signal PV having a period of one second is also output. On the other hand, only the output signal PN is obtained from the output terminal OUT-2 as a driving signal for the stepping motor 240.

Figure 16:
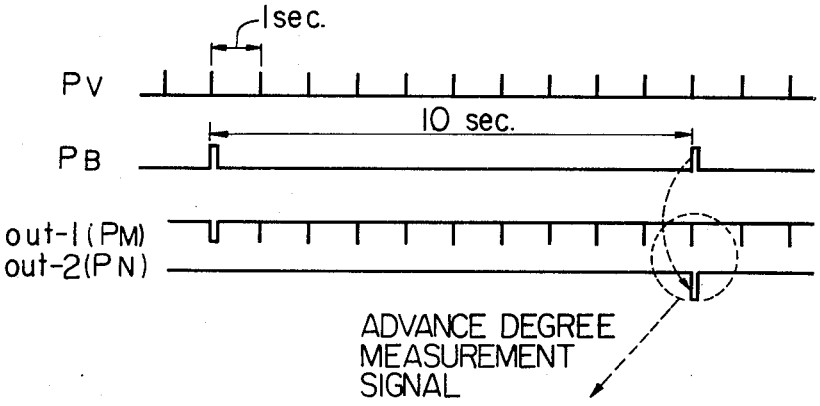
FIG. 16 is a timing chart for the waveforms used in the circuit of FIG. 15.

Signal timing will now be explained with reference to the timing charts shown in FIGS. 16 and 17. In FIG. 16, the advance degree measurement signal PV is a pulse having a period of one second. The seconds counter 226 produces output signal PB which has a ten second period and is in synchronism with the advance degree measurement signal PV. Driving signal PM, which is the logical sum of the measurement signal PV and a signal having a period of 10 seconds and in synchronism with the signal PB, appears at the output terminal OUT-1. Driving signal PN having a period of 20 seconds and which is 180 degrees out of phase with the driving signal PM and in synchronism with the output signal PB appears at the output terminal OUT-2.

Figure 17:
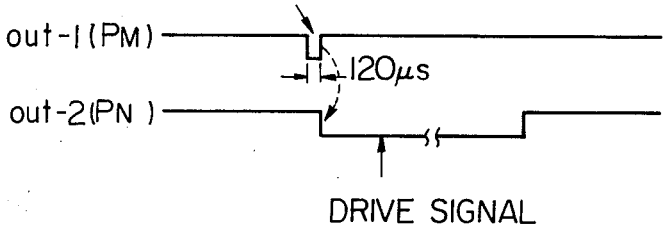
FIG. 17 is an enlarged view of the waveforms shown in FIG. 16.

FIG. 17 is an enlarged view of the driving signals PM and PN and shows their timing relationships. Driving signal PN as provided by the output terminal OUT-2 is produced after the completion of the measurement signal PV obtained from the terminal OUT-1; as a result, the measurement signal PV provided by the output terminal OUT-1 always procedes driving signal PN. This means that the leakage of magnetic flux from pulse the stepping motor 240 which is driven by this measurement signal PV can be detected by an advance degree measuring device and accurately measured in a short period of time.

The electronic timepiece shown in FIG. 14 thus permits a time correction to be performed by only a single correction switch, a feature which allows compact, slim timepieces to be readily produced without requiring conventional hand setting mechanisms. Moreover, since high and low speed time corrections are determined by how long the correction switch is operated, time corrections can be rapidly and accurately performed. As the timepiece is of the type in which the hands advance at 10 second intervals, an advance degree measurement signal can be used to easily and quickly perform an advance degree measurement. The timepiece as herein disclosed is thus readily operated, compact, low in cost and easily maintained.

Figure 18:
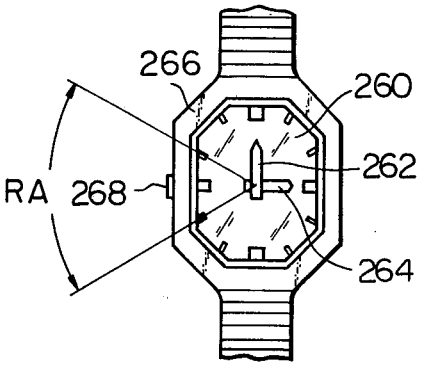
FIG. 18 is a plan view showing the external appearance of another example of a 2-hand analog quartz timepiece.

FIG. 18 is a plan view showing the external appearance of another preferred embodiment of a bracelet-type, two-hand analog crystal timepiece in accordance with this invention. In FIG. 18, reference numeral 260 denotes a dial, 262 a minutes hand, and 264 an hours hand. In this illustrated embodiment the timepiece is provided with an external control member in the form of a push-button 268 located at the side of a watch case 266 at a position corresponding to 9:00 o'clock on the dial.

Figure 19:
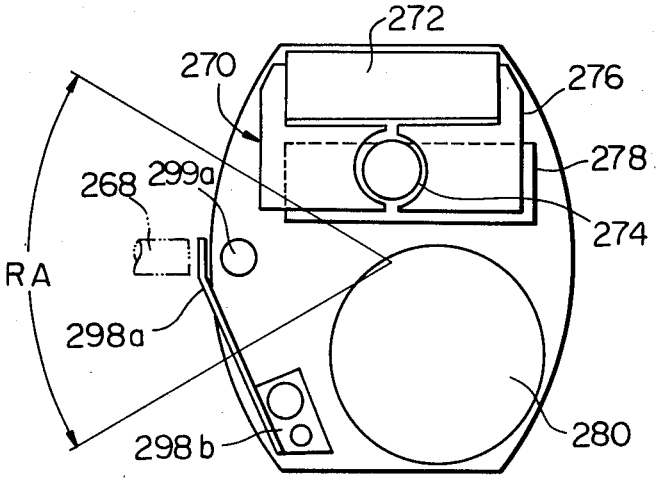
FIG. 19 is a plan view of the movement of the timepiece shown in FIG. 18.

FIG. 19 is a plan view showing the arrangement of the timepiece movement as seen facing the dial. The arrangement shows a stepping motor 270 composed of a coil 272, a rotor 274, and a stator 276, a quartz crystal oscillator 278 and a battery 280.

Figure 20:
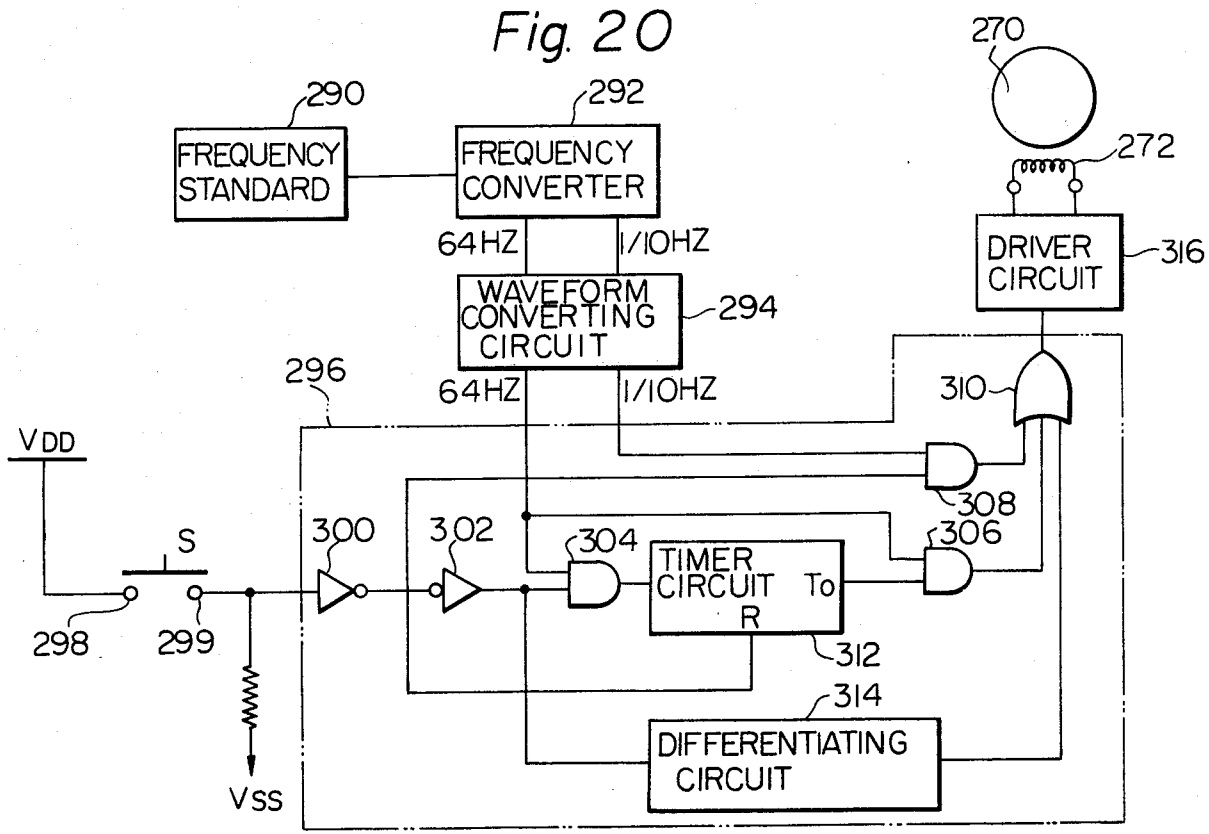
FIG. 20 is a detail block diagram of the electric circuitry for the timepiece shown in FIGS. 18 and 19.

FIG. 20 shows a block diagram of the circuitry for the timepiece shown in FIGS. 18 and 19. The timepiece comprises a frequency standard 290, and a frequency converter 292 which produces a 1/10 Hz signal and a 64 Hz signal. Each of these signals after being converted to a suitable pulse width by a wave-form converting circuit 294 are then applied as inputs to a time correction circuit 296. The correction pulse generating circuit 296 generally comprises a correction switch S associated with the pushbutton 268, inverters 300 annd 302, AND gates 304, 306 and 308, an OR gate 310, a timer circuit 312, a differentiating circuit 314, and a driver circuit 316. The 64 Hz signal is applied to one input terminal of the AND gates 304 and 306, and the 1/10 Hz signal is applied to one input terminal of the AND gate 308. One terminal 299 of the switch S which is opened or closed in response to the button 268 shown in FIG. 18 is connected to the input of the inverter 300 the output side of which is connected to the input of the inverter 302, reset terminal R of the timer 312 and the remaining input terminal of the AND gate 308. The output of the inverter 302 is connected to the remaining input terminal of the AND gate 304 and the input side of the differentiating circuit 314. The output signal from the AND gate 304 is applied to the input side of the timer 312 the output side of which is in turn connected to the remaining input side of the AND gate 306. The output sides of the AND gates 306 and 308 and the differentiating circuit 314 are all connected to the input side of the OR gate 310 which supplies output signals to the input side of the driver circuit 316.

When the button 268 is in the normally non-depressed state, the switch S is open, the terminal 299 is at a low logic level, the output of the inverter 300 is at a high logic level and the output of the inverter 302 is at a low level. Accordingly, the outputs of the AND gate 304, the timer 312, the AND gate 306 and the differentiating circuit 314 are all held at a low logic level. Therefore, only the 1/10 Hz signal is applied to the driver circuit 316 via the AND gate 308 and the OR gate 310. The stepping motor 270 is consequently driven step-wise once every ten seconds with the minutes hand 262 and the hours hand 264 thus advancing at ten-second intervals.

Depressing the button 268 for a short period of time causes the switch S to close instantaneously for an equivalent period to thereby instantaneously reverse the aforementioned logical states before they return to their normal logic levels. That is, the terminal 299 assumes a high logic level, the output of the inverter 300 a low logic level and the output of the inverter 302 a high logic level momentarily before returning to their original states. As a consequence the differentiating circuit 314 produces a single correction pulse which is applied across the OR gate 310 as an input signal to the driver circuit 316. This causes the motor 270 to be driven forward one step so that the minutes hand 262 and the hours hand 264 also advance one time.

If the button 268 is kept depressed beyond a prescribed period of time, the switch S is closed for an equivalent period and the outputs of the terminal 299, inverter 300 and inverter 302 all maintain their newly induced states, i.e., high, low and high logic levels, respectively. This renders the AND gate 308 off and the AND gate 304 on so that the 64 HZ signal is applied as an input to the timer 312. At the same time that the 64 Hz signals as counted by the timer 312 attain a prescribed value, output terminal. To of the timer 312 goes to a high logic level which causes the AND gate 306 to open. The 64 Hz signal is thus passed by the AND gate 306 and the OR gate 310 and applied as an input to the driver circuit 316. Accordingly, the stepping motor 270 is driven by 64 Hz driving pulses which causes the minutes hand 262 and the hours hand 264 to advance at a rapid rate. By releasing the button 268 and thereby opening the switch S, the outputs of the inverters 300 and 302 go to high and low logic levels, respectively. Accordingly, the timer 312 is reset, and the AND gates 304 and 306 are inhibited while the AND gate 308 is opened. In other words, the timepiece has returned to its normal run mode.

Thus in accordance with the time correction feature of the timepiece as herein embodied, a time correction is performed through the following procedure. The button 268 is depressed and hold in the depressed state beyond a certain prescribed period causing the minutes hand 262 and the hours hand 264 to be advanced in rapid fashion. Shortly before the hands of the timepiece have attained the desired correct setting, the button 262 is released and rapid advance of the hands ceases. Next, momentarily depressing the button 262 and releasing it in a repetitive manner for a required number of times advances the time indicating means one step at a time enabling the displayed time to be accurately set without difficulty.

In this illustrated embodiment the direction of hand movement for cases in which the button 262 is depressed momentarily or for cases in which it is depressed for a prolonged period has been chosen to coincide with the direction of hand advance during normal timepiece operation; however, it is equally permissible to adapt the invention such that the hands move for either the 64 Hz or 2 Hz signal in a direction opposite to the direction or normal hand advance.

The timepiece movement in accordance with the present embodiment has a barrel-shaped configurations as shown in FIG. 19. As this particular configuration allows for much freedom in design, it has been generally adopted for extremely compact timepieces such as bracelet-type watches. The barrel-shaped movement illustrated in FIG. 19 is an arrangement in which the coil 272, the stator 276 and the battery 280 are aligned in that order, the stator 276 being superimposed in planar fashion upon the crystal oscillator 278.

For movements of this construction, especially for cases in which the movement in barrel-shaped or non-circular, it is possible to greatly improve upon the efficient use of space by taking advantage of the interrelationship between the configuration of the movement and the shape of the timepiece elements.

In the diagram, a contact pin **299*a* forming one terminal 299 of the switch S is disposed in the vicinity of the left-hand side of the movement at a position corresponding to 9:00 o'clock. Extending opposite the pin 299*a* is a contact spring 298*a* which forms the other terminal 298 of the switch S. Disposing the battery 280 off-center at the right-hand side of the movement, as is the case in the present embodiment, creates a space for installation of the fixed terminal 298*b* of the contact spring 298*a*. In accordance with this construction it is possible to adopt the switching mechanism while utilizing only a very limited space even in a compact, barrel-shaped movement. It also goes without saying that the order of arrangement of the coil 272, stator 276 and battery 280** as herein described may be reversed while still leaving enough space for installation of the fixed portion of the contact spring.

According to this structure it is therefore possible to readily install in the vicinity of the left-hand side of the movement a switch including a contact spring and contact pin. In other words, it is possible to improve upon the efficient use of space in the movement as a whole by applying the present arrangement for the switching mechanism.

In the timepiece of the present embodiment as shown in FIG. 18, the button 268 is located at the side of the case 266 at a position corresponding to 9:00 o'clock on the dial. Adopting such an arrangement for the time correction button makes it appear at a glance as if an external control has been eliminated and this presents an extremely novel design for an analog display type timepiece. Moreover, by adopting a recessed type time correction button which does not greatly protrude from the side of the case 266 it is possible to prevent random operation of the wristwatch as well as provide an extremely simple and attractive design for a bracelet watch or similar timepiece. Adopting a button-type switch as the external control member for effecting the time adjustment allows for switch operation merely by depressing the button. Consequently, the external control member may be installed at the left-hand side of the timepiece anywhere between the positions corresponding to 8:00 and 10:00 o'clock on the clock dial without causing any inconvenience to the timepiece user when making at time correction.

Although the switching mechanism included within the movement must necessarily be installed in the vicinity of the corresponding external control member, disposing the switching mechanism comprising the contact pin and contact spring at the left-hand side of the movement is an extremely effective arrangement which makes the most efficient use of space.

The gist of the present invention as herein described therefore resides in installing an external control switch for time correction at the side of a case for an analog crystal timepiece anywhere between the positions corresponding to 8:00 and 10:00 o'clock on the timepiece dial. This removes the necessity of installing a handsetting mechanism, time setting wheels and a slip mechanism which were required components in conventional timepieces and thus makes it possible to design even smaller timepieces with inexpensive movements which are simple in structure and therefore more reliable. It is also now possible to provide even analog crystal timepieces which are novel in appearance and both simple and attractive in design. The present invention also improves upon the efficient use of space especially in the arrangement of a timepiece movement for such non-circular movements as those which possess barrel-shaped, eliptical or elongated configurations. It is additionally permissible to provide two buttons as external control members, one located in the vicinity of 8:00 o'clock on the dial and the other in the vicinity of 10:00 o'clock. Further, it is not absolutely necessary to install the external control member at the side of the timepiece case; the control member may equally well be disposed at the front of the timepiece along the side of the case anywhere between the positions corresponding to 8:00 and 10:00 o'clock on the dial or at the equivalent location on the back cover of the timepiece.

Figure 21:
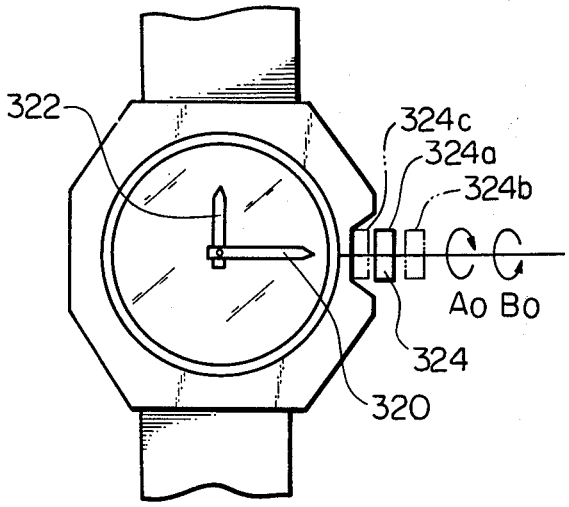
FIG. 21 is a plan view of the external appearance of still another example of a 2-hand analog quartz timepiece according to the present invention.

FIG. 21 is a plan view showing the external appearance of another preferred embodiment of a 2-hand analog quartz timepiece in accordance with this invention. In FIG. 21, the timepiece is equipped with a minutes hand 320 and hours hand 322 as an time indicating means, a crown 324 being provided as an external control member.

Figure 22:
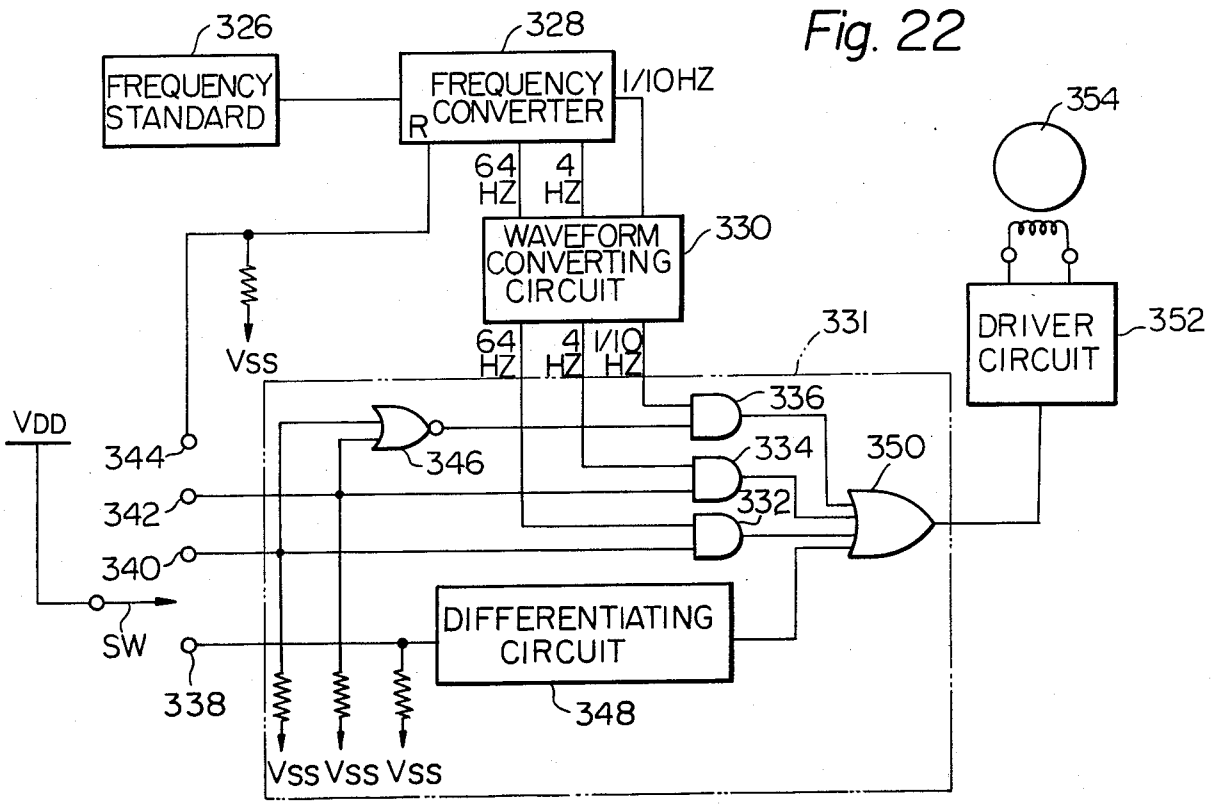
FIG. 22 is a detail block diagram of the electric circuitry for the timepiece shown in FIG. 21.

FIG. 22 shows a block diagram of the circuitry for the timepiece shown in FIG. 21. The timepiece comprises a frequency standard 326, and a frequency converter which produces 64 Hz, 4 Hz and 1/10 Hz signals. Each of these signals are converted to a suitable pulse width by waveform converting circuit 330. The 64 Hz, 4 Hz and 1/10 Hz signals are next applied to one input terminal of AND gate 332, AND gate 334 and AND gate 336, respectively, which form part of a time correction signal generating circuit 331. Among the correction control terminals 338–344, terminals 340 and 342 are connected to the remaining input terminals of respective AND gates 332 and 334, and also serve as the input terminals for a NOR gate 346, the output of which is connected to the remaining input terminal of the AND gate 336. Terminal 338 is connected to an input of a differentiating circuit 348 and terminal 344 is connected to the reset terminal R of the frequency converter 328. The outputs of the AND gates 332, 334 and 336 and the output of the differentiating circuit 348 are all applied to input S of an OR gate 350 which in turn supplies an output signal applied to a driver circuit 352 by which a stepping motor 354 is driven.

The opening and closure of a switch SW having a group of correction control terminals 338–344 is governed by the position of the crown 324 shown in FIG. 21. When the crown 324 is in position **324*a* which is the normal position for the crown, the switch SW is in a neutral position and hence there is no connection to any of the terminals 338–344. Accordingly, the correction control terminals 338–344 are all at a low logic level and the output of the NOR gate 346 is at a high logic level. As a result, only the 1/10 Hz signal is gated through the AND gate 336 and applied to the input of the OR gate 350 thereby driving the stepping motor 354 by means of a 1/10 Hz during pulse. Minutes hand 320 and hours hand 322** thus are normally advanced once every ten seconds.

For a time correction, the crown 324 is shifted to position **324*b* by pulling it out one step and is then rotated clockwise through a prescribed angle as shown by arrow Ao. Upon doing so, the switch SW closes the terminal 340 thereby raising this terminal only to a high logic level, and the output of the NOR gate 346 goes to a low logic level. Accordingly, only the 64 Hz signal is gated through the AND gate 332 and applied as a high speed correction signal to the input of the OR gate 350 thereby driving the stepping motor 354 by means of a 64 Hz driving pulse generated by the driver circuit 352**.

Next, when the crown 324 is shifted to position **324*b* by pulling it out one step and is then rotated counter-clockwise through a prescribed angle as shown by arrow Bo in FIG. 21, the switch SW closes the terminal 342 thereby driving the stepping motor 354** by means of a 4 Hz driving pulse.

When the crown 324 in position **324*b* is rotated neither clockwise nor counter-clockwise but is instead kept centered, the switch SW closes the terminal 344 and the frequency converter 328** is reset.

Finally, when the crown 324 is depressed from its normal position **324*a* to a position 324*c*, the switch SW closes the terminal 338 thereby raising this terminal to a high logic level which causes the differentiating circuit 348 to produce a single correction pulse applied to the input of the OR gate 350. In consequence, only a single correction pulse is applied to the driver circuit 352 and the stepping motor 354 is advanced through only one step. In this case it is permissible to employ a spring or like means to automatically return the crown to position the 324*a* after it has been depressed to the position 324*c***.

Thus, according to the structure of this illustrated embodiment, suitable manipulation of the crown 324 changes over the frequency of the driving pulses applied to the stepping motor 354 and makes it possible to advance the motor through one-step increments. In this case, the hands of the timepiece are advanced in a corresponding manner and thus a time correction can be readily performed.

While the stepping motor, when driven by the 64 Hz and 2 Hz correction signals and when advanced through one-step increments, rotates in the same direction as it does during normal timepiece operation, the arrangement may be modified such that the hands of the timepiece, when driven by the 4 Hz correction signal or when advanced through one-step increments, rotate in a direction opposite to the direction of normal hand advance. Alternatively, the 4 Hz correction signal may be completely omitted.

The gist of the present invention as herein described with reference to FIGS. 21 and 22 therefore resides in the provision of switching means operative to change over the frequency of the stepping motor driving pulse to a frequency higher than the pulse frequency during normal timepiece operation, and switching means each single manipulation of which is operative to advance the stepping motor one step at a time, both of said switching means being controlled by means of a single external control member thereby to perform a time correction. The external control member shown in FIG. 21 enables manipulation in both an axial and rotational direction so that a number of combinations and settings are possible. Thus, at least three positions, including the normal position, are available. The present invention therefore permits a time correction to be performed by an external control member such as a crown and a simple switching mechanism without requiring a hand setting mechanism, time setting wheels and a slip mechanism such as center wheels and a cannon pinion. This makes it possible to design smaller timepieces which are simple in structure and inexpensive to manufacture, assemble and adjust and hence more reliable in operation. Moreover, since the timepiece as herein described makes use of a crown, the time correction method resembles that employed to set a conventional timepiece so that the correction can be easily performed. A single external control member also does not detract from the external appearance of the watch.

Although the timepiece as herein embodied is constructed such that each depression of the crown drives the stepping motor through one step, an arrangement can also be adopted in which the same results are produced for each rotation of the crown in a given direction while set at any position. This could be accomplished by providing the periphery of the crown with a projection or cam which would make contact with a contact spring or the like whenever the crown is rotated or reciprocated.

Figure 23:
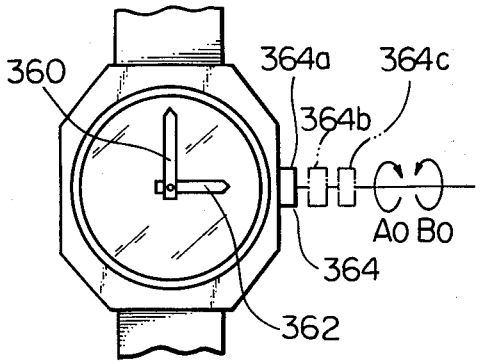
FIG. 23 is a plan view of the external appearance of still another example of a 2-hand analog quartz timepiece according to the present invention.

FIG. 23 shows a modified form of the two-hand analog crystal timepiece shown in FIG. 21. In FIG. 21, the timepiece is equipped with a minutes hand 360 and an hours hand 362 as a time-indicating means and is further provided with a crown 364 serving as an external control member.

Figure 24:
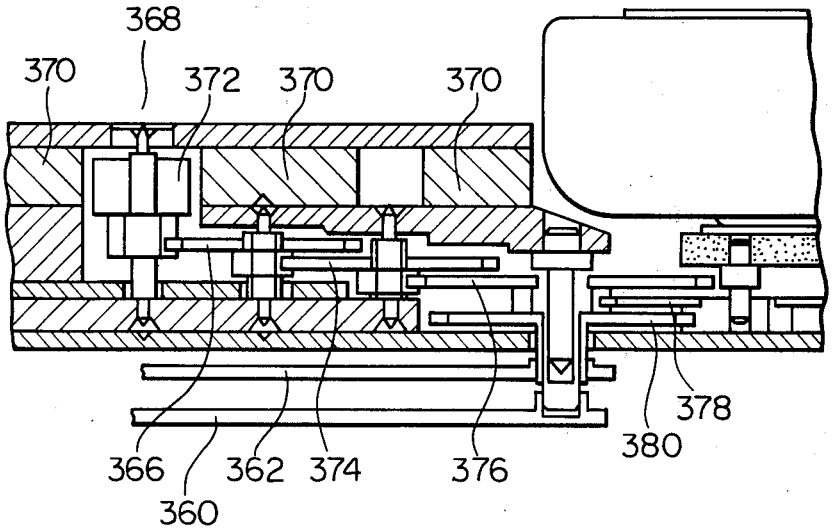
FIG. 24 is a cross section of the timepiece shown in FIG. 23.

FIG. 24 is a cross-sectional view of the movement of the timepiece shown in FIG. 24. The movement comprises a gear wheel 365 driven by a stopping motor 368 composed of a driving coil (not shown), a pair of stators 370, and a rotor 372. The gear wheel 336 drives a gear wheel 374, which in turn drives a center wheel 376. Indicated as 378 in minutes wheel and 380 is an hours wheel.

Figure 25:
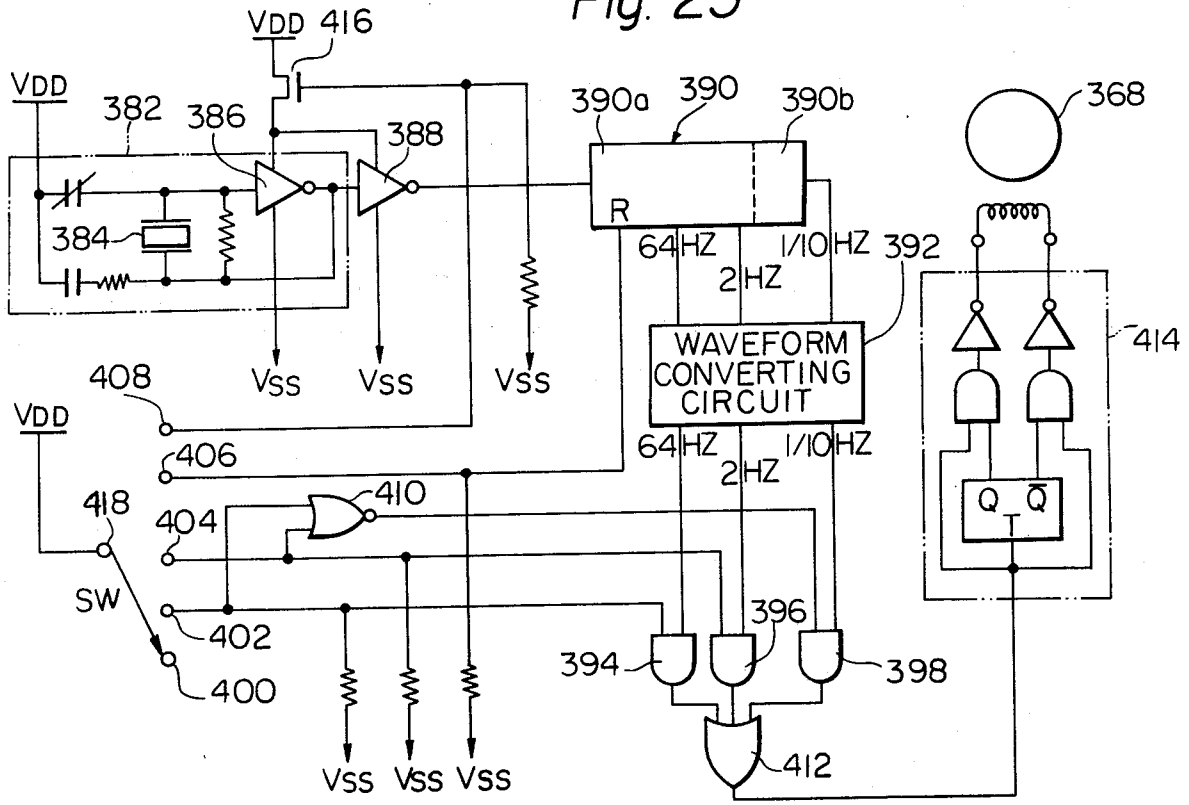
FIG. 25 is a detail block diagram of the electric circuitry for the timepiece shown in FIGS. 23 and 24.

FIG. 25 shows a circuit diagram of the analog crystal timepiece shown in FIG. 23. Here, a frequency standard 382 is composed of a quartz crystal 384, an inverter 386 and other components which are well known. A 32,768 Hz signal produced by the frequency standard 382 is fed through an inverter 388 which acts as a buffer circuit and is applied as an input to a frequency converter 390. The frequency converter 390 is comprised of a 1st divider section **390*a* which divides down the 32,768 Hz signal to a frequency of 1 Hz, and a 2nd divider section 390*b* which further divides the 1 Hz signal to a frequency of 1/10 Hz. Tapped off from the 1st divider section 390*a* are two output terminals for supplying respective 64 Hz and 2 Hz signals which, together with the 1/10 Hz signal obtained from the 2nd divider section 390*b*, are applied to wave-form converting circuit 392** as input signals.

The 64 Hz and 2 Hz signals as well as the 1/10 Hz signal are converted to a suitable pulse width by wave-form converting circuit 392 and then appear at respective terminals and as output signals. The 64 Hz and 2 Hz output signals are then applied to one input terminal of an AND gate 394 and an AND gate 396, respectively. The 1/10 Hz output signal is in like manner applied to one input terminal of an AND gate 398.

The opening and closure of a switch SW having a group of correction control terminals 402–408 is governed by the position of the crown 364 shown in FIG. 23. When the crown 364 is depressed to the maximum extent, shown by the position **364*a* which is the normal position for the crown, the switch SW is in a neutral position 400. The terminal 402 is connected to the remaining input terminal of the AND gate 394 and the terminal 404 is connected to the remaining input terminal of the AND gate 396. The terminals 402 and 404 are also connected to the input terminals of NOR gate 410 the output signals of which are applied to the remaining input terminal of the AND gate 398. The outputs of the AND gates 394, 396 and 398 are all applied to the input side of an OR gate 412 which in turn supplies an output signal applied to the input side of a driver circuit 414. The terminal 406 of the control terminal group is connected to a reset terminal R of the frequency converter 390, and the terminal 408 is connected to the gate electrode of a P-type MOS transistor 416** serving as a switching means.

When the crown 364 is in the position for normal operation, i.e., depressed to the maximum extent as shown by the position **364*a*, the switch SW is at neutral position 400 and the correction control terminals 402, 404, 406 and 408 are all at a low logic level; thus, the AND gates 394 and 396 do not produce 64 Hz or 2 Hz signal outputs. Furthermore, owing to the logic levels of the terminals 402 and 404, the NOR gate 410 produces a high level output whereby only the 1/10 Hz signal is applied to the OR gate 412 after being gated through the AND gate 398. Consequently, only the 1/10 Hz signal is applied to the driver circuit 414 thereby to drive the stepping motor 368 one step every ten seconds. The minutes hand 360 and hours hand 362 shown in FIG. 23** are normally advanced once every ten seconds, the minutes hand moving through one minute of time by being advanced six times.

Next, a description of the timepiece operation will be given for a case in which a time correction is performed.

The crown 364 shown in FIG. 23 is shifted to the position 364b by pulling it out one step and is rotated clockwise (in the direction of arrow Ao) through a prescribed angle and then held in that position. Upon doing so, the switch SW is shifted to the corresponding correction terminal 402 so as to complete the circuit between it and switch terminal 418. This raises the terminal 402 only to a high logic level and causes the NOR gate 410 to produce a low level output. Accordingly, the AND gate 394 produces a 64 Hz correction signal while the AND gates 296 and 398 produce no outputs whatsoever. Under these conditions, the OR gate 412 passes the 64 Hz signal only which is then applied to the input side of driver circuit 414. The stepping motor 368 is thus rotated at a rapid rate, namely, through 64 steps in one second. The minutes hand 360 and hours hand 362 also advance rapidly in conformance to the speed of the motor.

Next, the crown 364 in the position **364*b* is rotated counter-clockise (in the direction of arrow B) through a prescribe angle and then held in that position. Upon doing so, the switch SW is shifted to the corresponding correction terminal 404 so that only the terminal 404 is raised to a high logic level. The output of the NOR gate 410 goes to low level. Therefore, only the AND gate 396 produces an output which is the 2 Hz signal. Consequently, the OR gate 412 produces only the 2 Hz correction signal which is then applied to the input side of driver circuit 414. Under these conditions, the motor 368 is driven through two steps per second while the minutes hand 360 and hours hand 362** are advanced twice per second.

When the crown 364 in the position **364*b* is rotated neither clockwise nor counter-clockwise but is instead kept centered, the switch SW is shifted to the corresponding terminal 406 so that only the terminal 406 is raised to a high logic level. This signal is fed as an input to the reset terminal R of the frequency converter 390 which is thus reset. Under these conditions, the output signal from the NOR gate 10 is at a high logic level but no output is obtained from the output terminal of the waveform converting circuit 392 since the frequency converter 390 has been reset. As a result, the stepping motor 368** is not driven.

Thus when performing a time correction using the analog crystal timepiece illustrated in FIGS. 23 to 25, th correction is performed through the following procedure. The crown 364 is pulled out one step to the position **364*b*, rotated clockwise (in the direction of arrow Ao) through a prescribed angle and then held in that position. During this interval the minutes hand 360 and hours hand 362 advance in rapid fashion 64 times per second. Shortly before the hands of the timepiece have attained the desired correct setting, only the rotational position of the crown 364** is returned to the neutral center position. Manipulating the crown in this manner resets the timepiece and halts movement of the timepiece hands.

Next, with the crown 364 still in the position **364*b* it is rotated from the neutral position in a counter-clockwise direction (in the direction of arrow Bo), turned through a prescribed angle and then held in that position. At this time the minutes hand 300 and hours hand 362 advance at a comparatively slower rate, namely twice per second. At the same time that the hands of the timepiece attain the desired correct setting, the rotational position of the crown 364** is returned to the original position which completes the accurate time correction procedure and once again resets the timepiece.

When the crown 364 is returned to the position **364*a* by depressing it to its fullest extent, the timepiece is reset and normal operation once again commences. Ten seconds after the crown 364 is depressed to the position 364*a* the initial driving pulse for the stepping motor is produced. Thus, if after the time correction procedure the crown 364 is depressed to the position 364*a*** in accordance with a standard time signal, the timepiece can be set in an accurate manner.

The timepiece according to the present embodiment is also equipped with the switching means 416 as already described in order to conserve electrical power. If the crown 364 is pulled out two steps to the position **364*c*, the supply of electrical power to the frequency standard 382 can be terminated and the timepiece turned off. In other words, if the crown 364 is pulled out two steps to the position 364*c*, the switch SW is shifted to the corresponding terminal 408 thereby completing the circuit between it and the switch terminal 418. This raises the terminal 408 to a high logic level and turns the P-type MOS transistor 416 off. The supply of electrical power to the inverter 388 is thus terminated, the frequency standard 382** stop oscillating and power is conserved.

In this illustrated embodiment the crown 364 serving as the external control member is constructed so as to be rotatable clock-wise or counterclockwise through a predetermined angle while at the first step postion 346b. However, it is also permissible to employ the resiliency of a contact spring or the like as means for forcing the crown 364 to return to its neutral center position.

Figure 26:
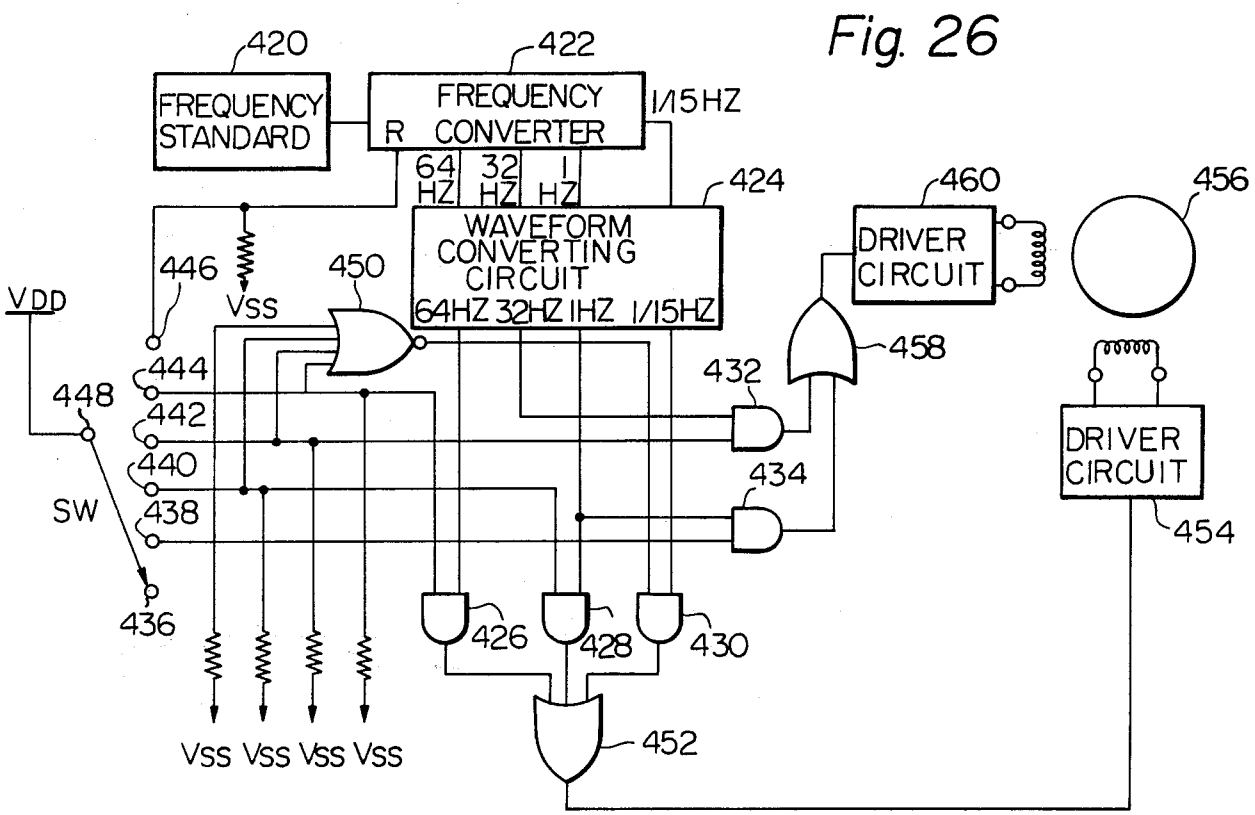
FIG. 26 is a block diagram showing a modification of the circuitry shown in FIG. 25.

FIG. 26 shows a circuit diagram of a modification of the timepiece shown in FIG. 25. In FIG. 26, the reference numeral 420 denotes a frequency standard and 422 a frequency converter which produces 64 Hz, 32 Hz and 1 Hz signals as well as a 1/15 Hz signal. Each of these signals is converted to a suitable pulse width by a pulseform converting circuit 424 before appearing as output signals at the corresponding output terminals. Of these output signals the 64 Hz and 1 Hz signals and the 1/15 Hz signal are applied to one input terminal of respective AND gates 426, 428 and 430, the 32 Hz and 1 Hz signals being connected to one input terminal of AND gates 432 and 434, respectively.

Among correction control terminals 438-446, the terminals 438, 440, 442 and 444 are connected to the remaining input terminals of respective AND gates 434, 428, 432 and 426, while the terminal 446 is connected to a reset terminal R of the frequency converter 422. The terminals 438, 440, 442 and 444 are also connected to the input side of a NOR gate 450 the output terminal of which is connected to the remaining input terminal of the AND gate 430. Reference numeral 436 denotes the neutral position of the switch SW.

The output terminals of the AND gates 426, 428, 430 are connected to the input side of an OR gate 452 the output of which is applied to the input side of a first driver circuit 454 operative to rotate a stepping motor 456 in a clockwise direction. In addition, the output terminals of the AND gates 432, 434 are connected to the input side of an OR gate 458 which supplies output signals to a second driver circuit 460 operative to rotate the stepping motor 456 in the reverse or counter-clockwise direction.

When the crown 364 shown in FIG. 23 is in the normal position **364*a*, the stepping motor 456 is driven in a clockwise direction at a frequency of 1/15 Hz. Next, when the crown 364 is pulled out one step to the position 364*b* and rotated in the clockwise direction, the switch SW completes the circuit between the terminals 440 and 448 whereby the stepping motor 456 is driven in the clockwise direction at a frequency of 1 Hz. If the crown 364 is rotated in the counter-clockwise direction, the switch SW completes the circuit between the terminals 438 and 448 so that the motor 456 is driven in the opposite or counter-clockwise direction at a frequency of 1 Hz. If the crown 364 is pulled out two steps to the position 364*c* and rotated in the clockwise direction, the switch SW completes the circuit between the terminals 444 and 448 so that the motor 456 is driven in the clockwise direction by the 64 Hz correction signal. If the crown 364 is rotated in the counter-clockwise direction, the switch SW completes the circuit between the terminals 442 and 448 so that the motor 456** is driven in the reverse or counter-clockwise direction by the 32 Hz correction signal.

When the crown 364 in the position 364c is rotated neither clockwise nor counter-clockwise but is instead kept centered, the switch SW completes the circuit between the terminals 446 and 448 and the frequency converter 422 is reset.

In accordance with this construction, the speed of the time-indicating hands as well as their direction of motion during the correction procedure can be chosen according to need so that the time correction is capable of being accomplished in a readible manner.

Figure 27:
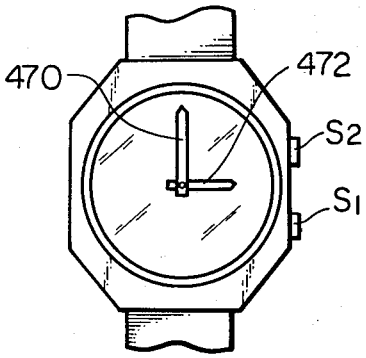
FIG. 27 is a plan view of the external appearance of a 2-hand analog quartz timepiece employing push-button switches for a time correction.

FIG. 27 is a plan view showing the external appearance of a modification of the timepiece shown in FIG. 23. In FIG. 27, the timepiece is equipped with a minutes hand 470 and hours hand 472 as a time-indicating means and is further provided with pushbutton type switches S1 and S2 as external control members.

Figure 28:
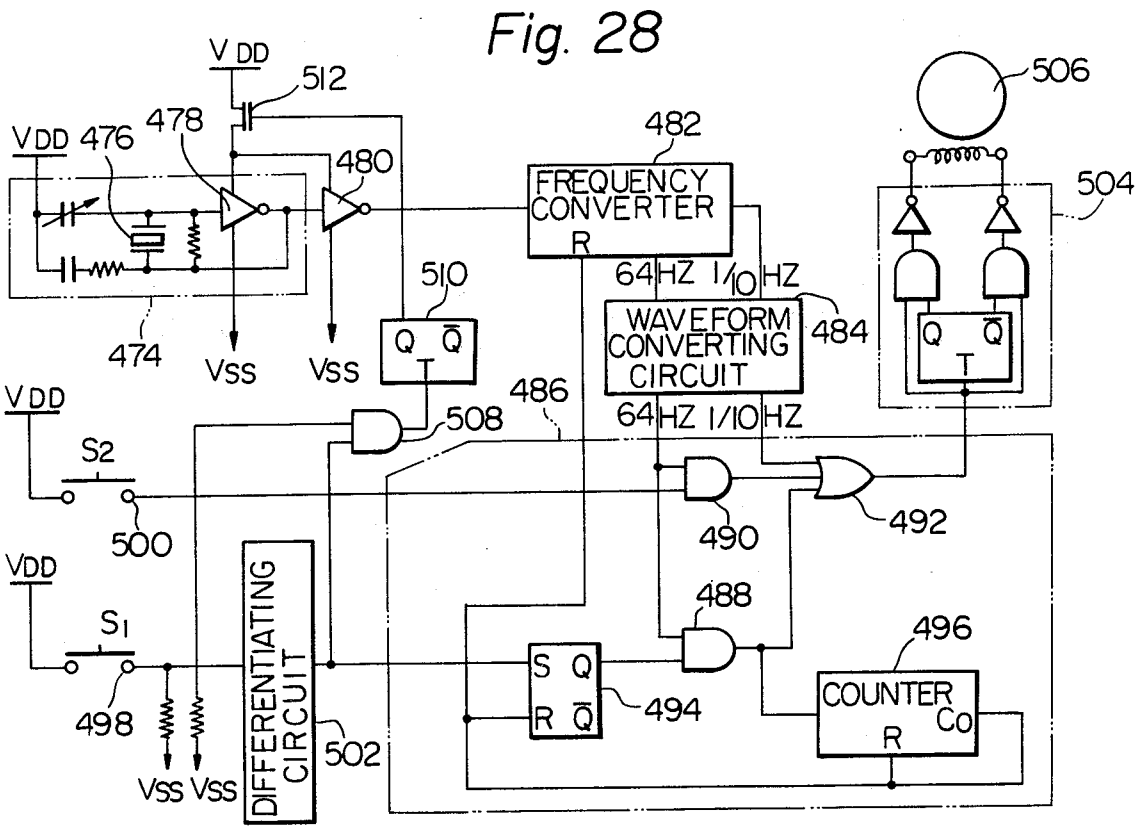
FIG. 28 is a detail block diagram of the electric circuitry for the timepiece shown in FIG. 27.

FIG. 28 shows a circuit diagram of the timepiece shown in FIG. 27. In FIG. 28, a frequency standard 474 is composed of a quartz crystal 476, an inverter 478 and other components which are well known. A 32,768 Hz signal produced by the frequency standard 474 is fed through an inverter 480 which acts as a buffer circuit and is applied as an input to a frequency converter 482. The frequency converter 482 produces a 64 Hz output signal and a 1/10 Hz output, signal which are converted to a suitable pulse width by a wave-form converting circuit 484 before being applied to a correction signal generating circuit 486. The 64 Hz output signal is applied to one input terminal of an AND gate 488 and an AND gate 490 and the 1/10 Hz output signal is applied to one input terminal of an OR gate 492. In addition to the AND gates 488 and 490 and the OR gate 492, the correction signal generating circuit 486 also includes a flip-flop (FF) 494 and a counter 496. One terminal 498 of the push-button type switch S1 shown in FIG. 27 is connected across a differentiating circuit 502 to the set terminal S of FF 494 while one terminal 500 of the push-button type switch S2 is connected to the remaining input terminal of the AND gate 490. The output terminal of the AND gate 490 is connected to one input terminal of the OR gate 492 and the output terminal Q of FF 494 is connected to the remaining input terminal of the AND gate 488. The output terminal of the AND gate 488 is connected to one input terminal of the OR gate 492 and to the input side of the counter 496. The output terminal of the counter 496 is connected to its own reset terminal R, the reset terminal R of FF 494 and the reset terminal R of the frequency converter 482. Finally, the output of the OR gate 492 is connected to a driver circuit 504 by which a stepping motor 506 is driven.

When the switches S1 and S2 are both in their normally opened states, the terminals 498 and 500 are both at a low logic level, FF 494 is in the reset state, and the AND gates 488 and 500 are inhibited. Accordingly, only the 1/10 output signal is applied to the driver circuit 504 via the OR gate 492. As a consequence, the stepping motor 506 is driven step-wise one step every ten seconds.

When the switch S2 is closed, the terminal 500 rises to a high logic level and the AND gate 490 is opened. Thus, the 64 Hz signal is applied to the stepping motor 506 across the AND gate 490 and the OR gate 492 during the interval that the switch S2 is depressed. This 64 Hz driving pulse causes the stepping motor 506 to be driven at a high speed.

When the switch S1 is closed, the terminal 498 rises to a high logic level and the differentiating circuit 502 produces a single pulse. This sets FF 494 by causing it to reverse state and opens the AND gate 488. The 64 Hz signal is thus gated through the AND gate 488 and applied to the OR gate 492 and the counter 496. At this time, the counter 496 begins to count 6 pulses and its output terminal Co is raised to a high level by changing state. However, since the terminal Co is connected to the reset terminal R of the counter 496, the counter instantaneously resets itself and the terminal Co returns to a low logic level. In this manner, the output terminal Co is reversed to a high logic level and then returned to a low logic level in an instantaneous fashion thereby returning both FF 494 to a reset state and the AND gate 488 to an OFF state. The frequency converter 482 is instantaneously reset and then once again returned to its normal state. As a consequence of these operations, only six pulses of the 64 Hz signal are passed by the AND gate 488 and applied to the OR gate 492 and the counter 496, upon which the timepiece once again returns to its normally operating state. Accordingly, each time the switch S1 is closed once, six pulses are applied to the driver circuit 504 which drives the stepping motor 506 through six steps.

Thus in this illustrated embodiment, a time correction is performed through the following procedure.

The switch S2 is closed causing the time-indicating means comprising the minutes hand 470 and hours hand 472 to advance at a rapid rate. Several minutes before the hands of the time-indicating means have attained the desired correct setting, the switch S2 is released and rapid advance of the hands ceases. Next, depressing the switch S1 and releasing it in a repetitive manner a required number of times advances the hands of the timepiece a prescribed number of steps enabling the displayed time to be corrected by setting the hands to the desired time.

In this illustrated embodiment, the time-indicating mean is such that the hands are repetitively advanced through one-minute units for each six steps of the stepping motor. This construction which drives the stepping motor through six steps each time the switch S1 is depressed allows the time to be corrected by a simple operation.

In order to prevent the random depression of the button-type switch adopted as the time correcting member in the present invention, the adoption of a button switch with a recessed head must be considered although this will involve some difficulty in manipulating the switch. For a case in which a construction is adopted wherein depressing the switch S1 one time drives the stepping motor 506 through only one step, it will be necessary to depress the switch S1 six times in order to advance the hands of the timepiece by one minute, a time consuming corrective operation that is not desirable. From these points it can be appreciated that the time correction mechanism as adopted by this embodiment is by far the most effective.

Next, if the switches S1 and S2 are simultaneously closed, the output of an AND circuit 508 attains a high logic level, FF 510 is set and a P-channel MOS transistor 512 is turned off. This cuts off the supply of electrical power to the frequency standard 474 and conserves the power. If the switches S1 and S2 are closed simultaneously one more time, FF 510 is reset allowing the timepiece to be returned to its normal operating state. The present embodiment therefore does not require a separate switch for power conservation.

Figure 29:
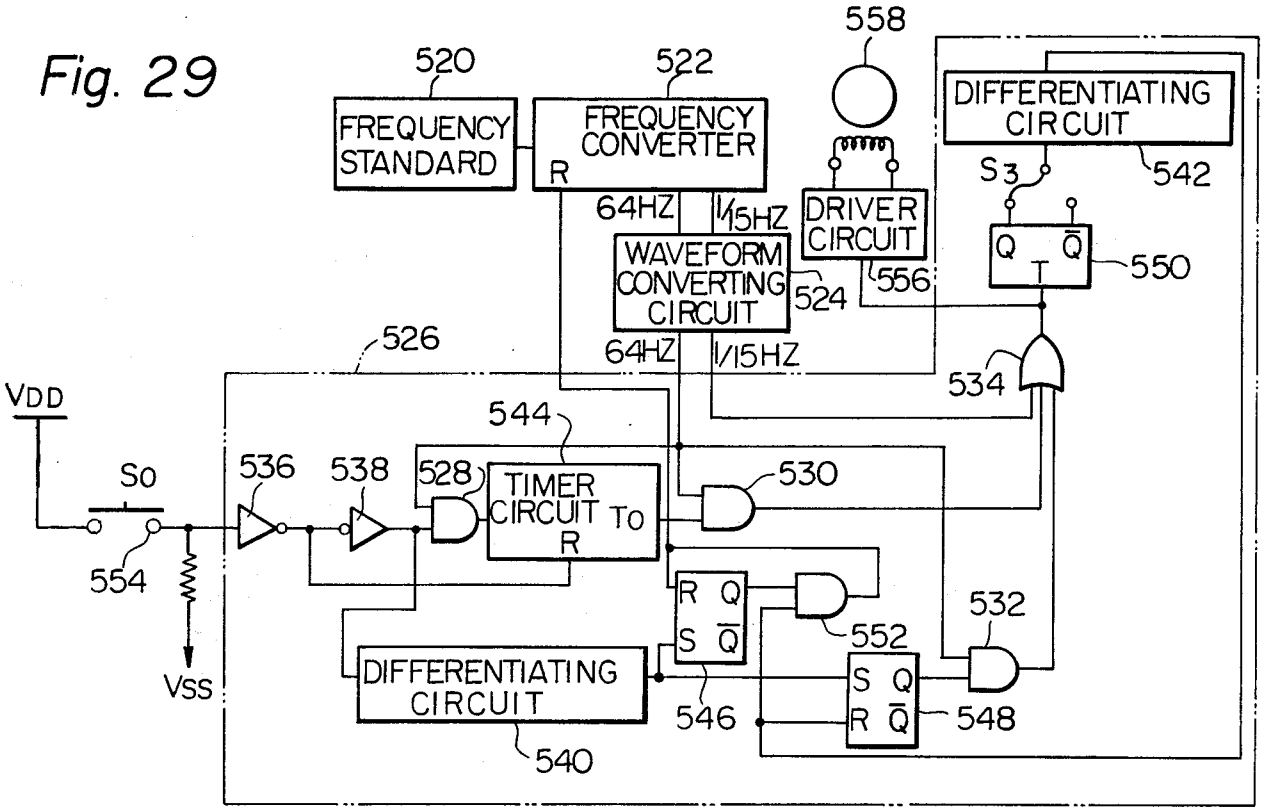
FIG. 29 is a detail block diagram showing a modified form of the circuitry of FIG. 28.

FIG. 29 shows a modified form of the circuit shown in FIG. 28. In FIG. 29, the reference numeral 520 denotes a frequency standard, and 522 a frequency converter. The frequency converter 522 produces a 64 Hz signal and a 1/15 Hz signal which are applied to a correction signal generating circuit 526 across a wave-form converting circuit 524. The 64 Hz signal is applied to one input terminal of an AND gates 528, 530 and 532 and the 1/15 Hz signal is applied to one input terminal of an OR gate 534. In addition to the AND gates 528, 530 and 532 and the OR gate 534, the correction signal generating circuit 526 includes inverters 536 and 538, differentiating circuits 540 and 542, a timer circuit 544, FF 546, 548 and 550 and an AND gate 552. One terminal 554 of a single switch So is connected to the input of the inverter 536. Finally, the output of the OR gate 534 is connected to terminal T of FF 550 and the input side of a driver circuit 556 by which a stepping motor 558 is driven.

When the switch So is in the normally open state, the terminal 554 is at a low logic level so that the output of the inverter 536 is at a high level, the output of the inverter 538 is at a low level and the AND gate 528 is inhibited. This holds the timer circuit 544 in the reset state and the AND gate 530 is inhibited. The output terminal of the differentiating circuit 540 is also maintained at a low logic level, FF 546 and 548 are in the reset state, and the AND gates 552 and 532 are inhibited. Accordingly, only the 1/15 signal is applied to the driver circuit 556 via the OR gate 534. As a consequence, the stepping motor 558 is driven step-wise one step every 15 seconds.

When the switch So is closed for a short period of time, the output of the inverter 536 goes to a high logic level for an equivalent period whereby the differentiating circuit 540 produces a single pulse. This sets FF 546 and 548, causes the AND gates 552 and 532 to open, and applies the 64 Hz signal to the OR gate 534 across the AND gate 532. Since the output of the OR gate 534 is connected to the terminal T of FF 550 as well to the driver circuit 556, FF 550 performs a toggle-like function every time the OR gate 534 produces a single output pulse. Consequently, the differentiating circuit 542 produces an output pulse every time FF 550 is set by a reversal in state. This pulse once again returns FF 548 to the reset state thereby to inhibit the AND gate 532, passes through the AND gate 552 which is in the open state, momentarily resets the frequency converter 522 and returns FF 546 to the reset state and hence the AND gate 552 to the OFF state.

It follows from these operations that the initial closure of the switch So for a short period of time results in the production of one or two pulses which are passed by the AND gate 532 and applied by the OR gate 534 to the driver circuit 556 and FF 550 at which time the circuitry is returned to the normal operating state. In other words, for the initial single closure of the switch So, the circuitry is returned to the normal operating state after the stepping motor 558 is driven through one or two steps, that is, after the hands of the timepiece have advanced through 15 or 30 seconds.

If the switch So is closed for a short period of time in a repetitive manner, stepping motor 558 is driven through two steps for each closure of the switch from the second closure onward.

Whether or not the stepping motor 558 is driven through one step or two steps for the initial closure of the switch So will depend upon whether FF 550 is in the reset or set state at that time; the probability that either of these two states will be encountered is 50%.

Due to these circumstances the modification of FIG. 29 features a switch S3 which is installed betwee the input side of the differentiating circuit 542 and the output side of FF 550. Switch S3 is a simple switch which is readily changed over by a screwdriver or pincets once the back cover of the timepiece has been removed. Accordingly, if the switch S3 is set during assembly or when changing the battery so as to suitably select connection between the input side of the differentiating circuit 542 and either the Q or Q output terminals of FF 550, the setting of the time-indicating means and the oogical state of FF 550 can be brought into phase so as to set the minutes hand 470 exactly to the minute whenever a time correction is performed.

If the switch So is kept closed beyond a prescribed period of time, for an equivalent period the terminal 554 is held at a high logic level, the output of the inverter 536 at a low logic level, the output of the inverter 538 at a high logic level, the AND gate 528 remains opened and the timer circuit 544 is removed from the reset state. The 64 Hz signal is therefore gate through the AND gate 528 and applied to the input of the timer 544 the output terminal To of which goes to a high logic level the moment the number of 64 Hz pulses as counted by the timer reach a prescribed value. Consequently, the AND gate 530 is opened and the 64 Hz signal is gated through the AND gate 530 and the OR gate 534 and applied to the driver circuit 556. Stepping motor 558 is thus driven by 64 Hz driving pulses such that the hands of the time-indicating means advance at a rapid rate.

If the switch So is now released from the closed state, the output of the inverter 536 returns to a high logic level, the timer 544 is reset and its output terminal To assumes a low logic level. This returns the AND gate 530 to the OFF state and hence the timepiece to the normal operating condition.

Thus in accodance with the time correction feature of the timepiece as herein embodied, a time correction may be performed through the following procedure.

The switch So is closed and held in the closed state beyond a certain prescribed period causing the minutes hand and hours hand to be advanced in rapid fashion. Several minutes before the hands of the timepiece have attained the desired correct setting, the switch So is released and rapid advance of the hands ceases. Next, depressing the switch So for a short period of time and releasing it in a repetitive manner for a required number of times advances the time-indicating means the prescribed acount for each depression of the switch enabling the displayed time to be corrected by setting the hands to the desired time.

It will now be understood that the gist of the present invention as herein described resides in a time correction mechanism comprising 1st control switching means for changing over the frequency of a stepping motor driving pulse to a frequency higher than the pulse frequency during normal timepiece operation, and 2nd control switching means for supplying the stepping motor with a prescribed number of driving pulses each time the 2nd control switching means is operated, the 1st and 2nd switching means being manipulated by an external control member thereby to perform a time correction.

Figure 30:
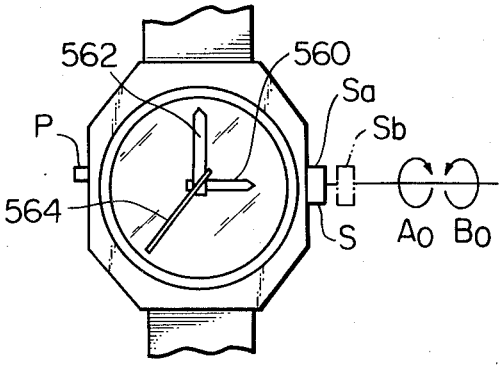
FIG. 30 is a plan view of the external appearance of a 3-hand analog quartz timepiece employing a crown type switch for a time correction and a push-button for a click mechanism.

FIG. 30 is a plan view of still another preferred embodiment of timepiece in accordance with the present invention. In FIG. 30, the timepiece is equipped with an hours hand 560, minutes hand 562 and seconds hand 564 as the time-indicating means and is further provided with a crown-type switch S and a push button P as external control members. Push button P is the external control member for a click mechanism which shifts only the hours hand 560 step-wise through 30 degree increments.

Figure 31:
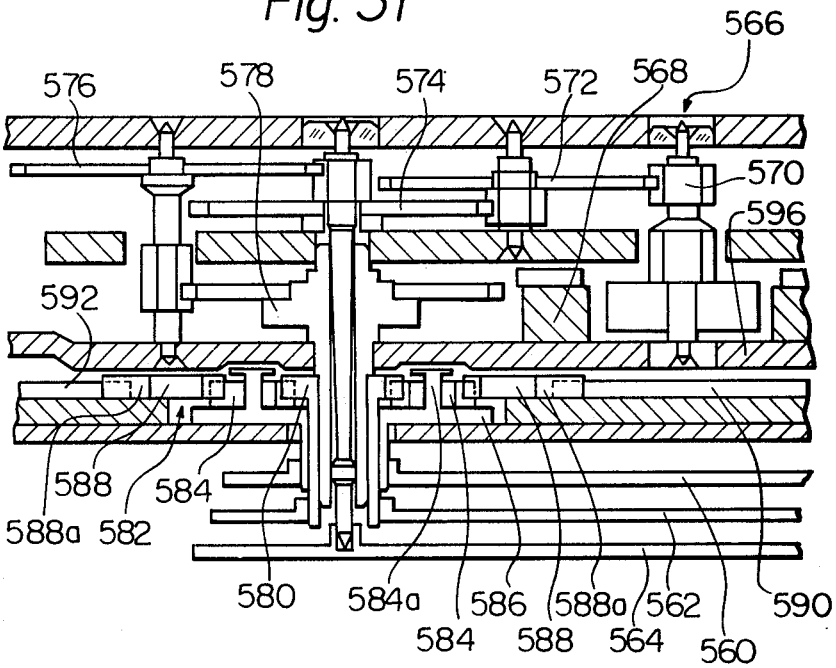
FIG. 31 is a cross section of the timepiece shown in FIG. 30.
Figure 32:
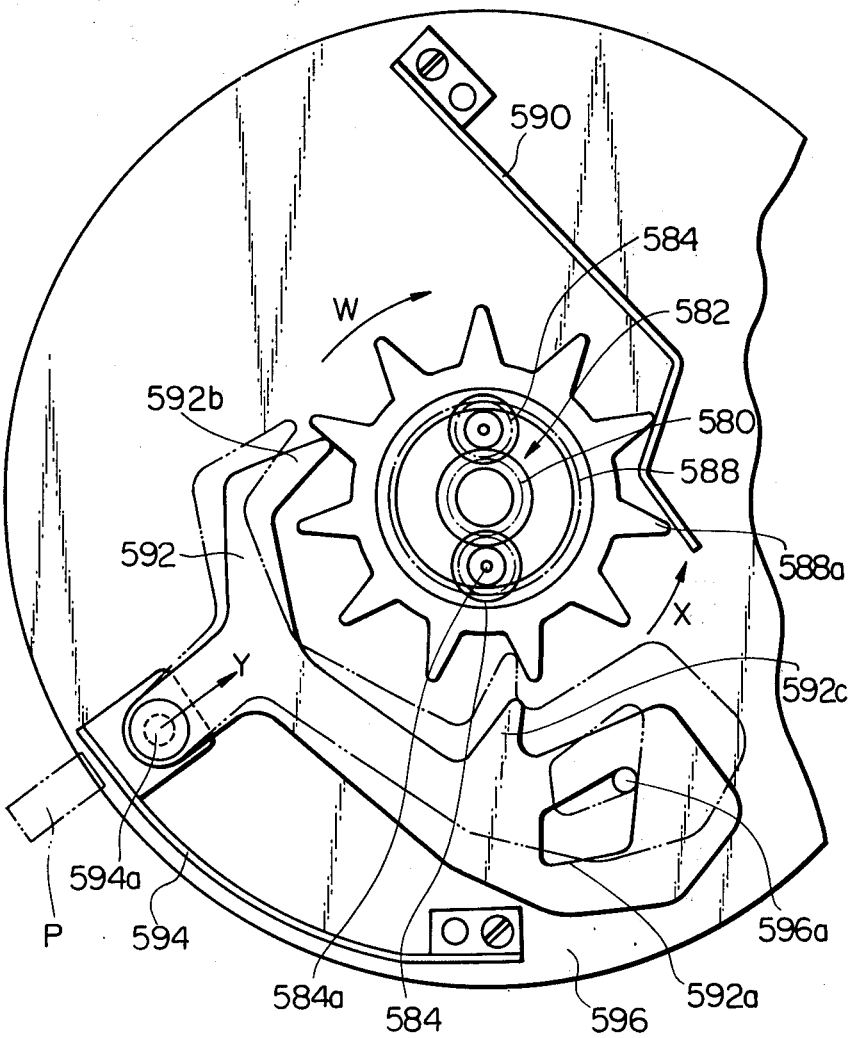
FIG. 32 is a plan view of essential parts of the movement of the timepiece shown in FIG. 30.

FIG. 31 shows in cross section the movement of the timepiece shown in FIG. 30. FIG. 32 shows a schematic plan view of the click mechanism in which a portion of the components associated with the hours wheel or the like have been omitted.

In FIG. 31, a stepping motor 566 comprises a driving coil (not shown), a stator 568, a rotor 570 and other such components is driven by electronic circuitry through one step per second during normal timepiece operation. The rotation of the rotor 570 is transmitted to a 5th wheel and pinion 572, a seconds wheel 574, a 3rd wheel and pinion 576 and a minutes wheel 578 in that order. A sun gear 580 of a differential gear means 582 is fixed to one portion of the minutes wheel 578 so as to rotate in unison therewith. The differential gear means 582 include, in addition to the sun gear 580, two planet gears 584, an hours wheel 586 mounted on a shaft 584*a* of the planet gear 584 and a ring gear 588, the planet gears 584 engaging both the sun gear 580 and ring gear 588.

In FIG. 32, the outer circumference of the ring gear 588 is provided with 11 triangular teeth 588*a* which engage with a jumper spring 15 to position and hold stationary the ring gear 588. Thus, the rotation of the sun gear 580 which makes one complete revolution per hour is reduced and transmitted by the differential gear means 582 thereby to rotate through one revolution every 12 hours the hours wheel 586 mounted on the shaft 584*a* of the planet gear 584. In other words, the differential gear means 582 function as does a minutes wheel found in conventional timepieces during normal timepiece operation when the ring gear 588 is stationary.

The click mechanism which shifts the hours hand 560 step-wise through increments of 30 degrees operates as follows. In addition to the differential gear means 582 and jumper spring 590, the click mechanism also includes an hours corrector 592 and an hours corrector spring 594, a push button P beng provided as an external control member. A rivet 594*a* secured to a portion of the hours corrector spring 594 serves to provide axial support for the hours corrector 592 so that it is freely rotatable. An elongated hole 592*a* formed in the hours corrector 592 is in engagement with a pin 596*a* projecting from a plate 596. According to this arrangement, the position of the hours corrector 592 is governed by the direction of the force of gravity and the attitude of the timepiece itself; as a result, either of pawls 592*b* or 592*c* of the hours corrector 592 engage the triangular teeth 588*a* of the ring gear 588. In other words, when the timepiece is in an attitude such that the 12:00 o'clock position on the dial is above the 6:00 o'clock position, the weight of the hours corrector 592 brings the pawl 592*b* into engagement with the triangular teeth 588*a*; if the attitude of the timepiece is reversed, the pawl 592*c* will engage the teeth 588*a*.

With the hours corrector 592 in the position indicated by the solid line and the pawl 592*b* engaging the triangular teeth 588*a*, depressing the push button P causes the hours corrector spring 594 to push the hours corrector 592 in the direction of arrow Y whereby the pawl 592*b* pushes the triangular tooth 588*a* in the direction of arrow W. As a consequence, the ring gear 588 rotates in the direction of arrow W through one pitch or one-eleventh of a revolution while the hours wheel (FIG. 31) mounted on the shaft 584*a* of the planet gear 584 rotates in the direction of arrow W through one-twelfth of a revolution or 30 degrees. The hours hand 560 is thus advanced in a clock-wise direction through 30 degrees or one hour of time without any affect upon the minutes hand 562 and the seconds hand 564.

With the hours corrector 592 in the position indicated by the phantom line and the pawl 592*c* engaging the triangular teeth 588*a*, depressing the push button P causes the hours corrector spring 594 to push the hours corrector 592 in the direction of arrow Y whereby the hours hand 560 is now shifted in the direction of arrow X or counter-clockwise through 30 degrees.

Figure 33:
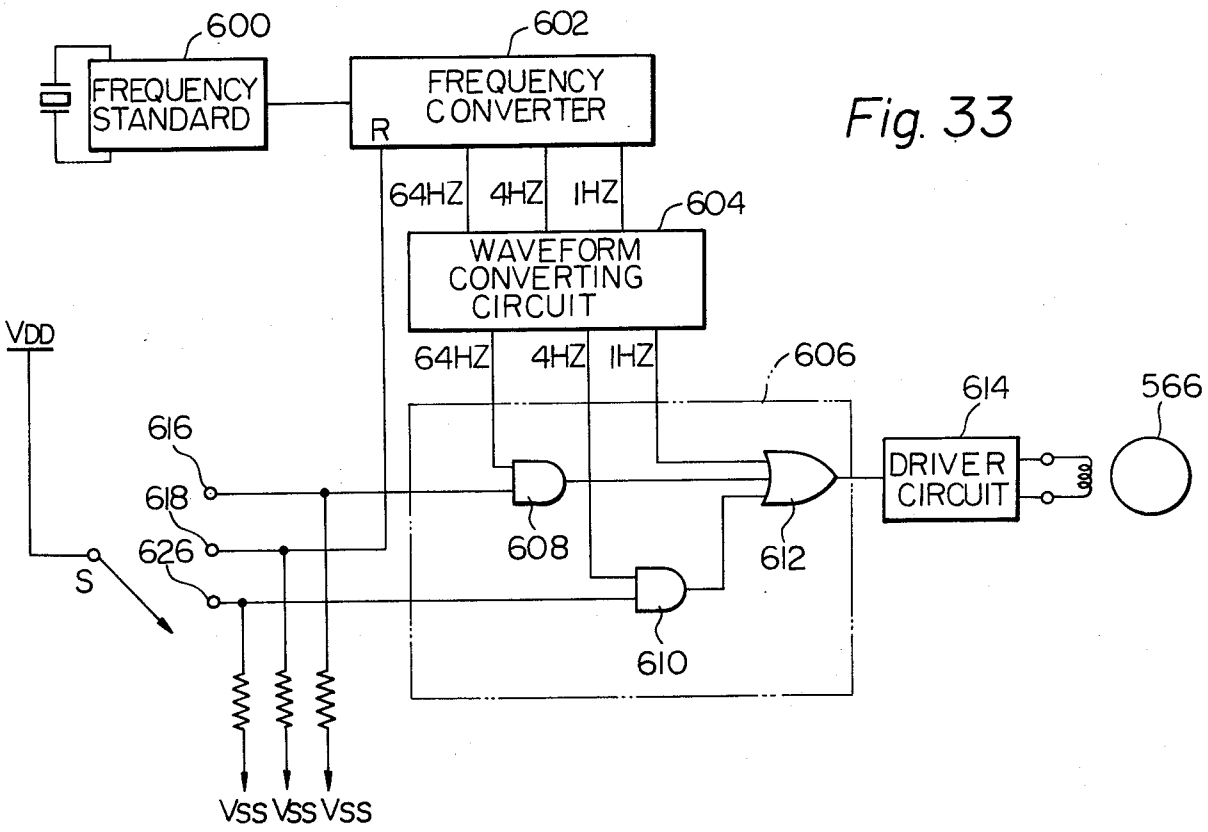
FIG. 33 is a detail block diagram for the electric circuitry for the timepiece shown in FIG. 30.

FIG. 33 shows a block diagram of the circuitry for the timepiece shown in FIGS. 30 to 32. In FIG. 33, the reference numeral 600 denotes a frequency standard and 602 a frequency converter which produces 64 Hz and 4 Hz signals as well as a 1 Hz standard signal. Each of these signals after being converted to a suitable pulse width by a wave-form converting circuit 604 are then applied as inputs to a correction signal generating circuit 606. The 64 Hz and 4 Hz signals are then applied to one input terminal of respective AND gates 608 and 610 of the correction signal generating circuit 606. The outputs of the AND gates 608 and 610 and the 1 Hz standard signal are connected to inputs of an OR gate 612, which generates output signals to a driver circuit 614.

A group of correction control terminals 616–620 are provided and serve as the terminals for the crown-type switch S. Terminals 616 and 620 are connected to the remaining input terminals of respective AND gates 608 and 610, and terminal 618 is connected to the reset terminal R of the frequency converter 602.

When the crown S is in the position for normal operation, i.e., depressed to the maximum extent as shown by the position Sa in FIG. 30, there is no connection to any of the correction control terminals 616–620 of the switch S. Accordingly, the correction control terminals 615–620 are all at a low logic level and the AND gates 608 and 610 are inhibited. As a result, only the 1 Hz standard signal is normally gated through the OR gate 612 and applied to the driver circuit 614 thereby driving the stepping motor 566 continuously at a rate of one step per second.

Next, the crown-type switch S shown in FIG. 30 is shifted to the position Sb by pulling it out one step and it is rotated clockwise (in the direction of arrow Ao) through a prescribed angle and then held in that position. Upon doing so, the switch S closes terminal 616 thereby raising this terminal only to a high logic level and causing the AND gate 608 to open. As a result, the 64 Hz signal is gated through the AND gate 608 and the OR gate 612 and applied to the driver circuit 614. The stepping motor 566 is thus driven at a high speed of 64 steps per second which causes the seconds hand 564 to advance at a rapid rate.

The switch S in the position Sb is now rotated counter-clockwise (in the direction of arrow Bo) through a prescribed angle and then held in that position. Upon doing so, the switch S closes the terminal 620 thereby raising this terminal only to a high logic level while causing the AND gate 608 to be inhibited and the AND gate 610 to open. As a result, the 4 Hz signal is passed by the AND gate 610 and the OR gate 612 and applied to the driver circuit 614 thus driving the stepping motor 566 at a speed of four steps per second.

When the switch S in the position Sb is rotated neither clockwise nor counter-clockwise but is instead kept centered, the switch S closes the terminal 618 thereby raising this terminal only to a high logic level so as to reset the frequency converter 602. As a result, the timepiece is nonoperative since none of the abovementioned signals are supplied to the driver circuit 614.

When necessary, the push-button P is depressed to actuate the click mechanism which shifts the hours hand of the timepiece to a suitable position just before the desied setting. Next, the crown-type switch S is pulled out one step to the position Sb and then rotated in the clockwise direction (in the direction of arrow A) thereby driving the stepping motor 566 at a high speed. Shortly before the hours hand 560, minutes hand 562 and seconds hand 564 have attained the desired correct setting, returning the rotational position of the switch to its center position causes high speed advance of the hands to cease. Next, if the switch S is rotated in the counter-clockwise direction, thereby to drive the stepping motor 566 by means of a 4 Hz driving pulse, the hands of the timepiece can readily be set to the desired time. When it is desired to start a corrected timepiece in synchronism with a standard time signal, this can be accomplished by depressing the switch S from the position Sb the instant the time signal is broadcast.

In accordance with the time correction mechanism of this illustrated embodiment, a time correction even for a three-hand timepiece can be readily performd by manipulating the push button P to actuate the click mechanism and by manipulating the crown-type switch S to vary the state of the driving pulse applied to the stepping motor 566. This removes the necessity of installing a hand-setting mechanism, time setting wheels and a slip mechanism which were required components in conventional time-pieces and thus makes it possible to design even smaller and slimmer wristwatches with inexpensive movements which are simple in structure and therefore more reliable.

The time correction mechanism in this illustrated embodiment is well suited to the needs of travelers who pass through varying time zones since the click mechanism as herein embodied allows the hours hand only to be shifted step-wise through increments of 30 degrees or one hour without affecting the minutes and seconds hands. It is thus possible to correct for changes in time zone without unnecessarily disturbing the minutes and seconds hands of the timepiece which is continuing to function in an accurate manner. The click mechanism of this embodiment also allows the hours hand to be shifted step-wise in a clockwise or counter-clockwise direction by suitably controlling the attitude of the timepiece with respect to the direction of the force of gravity, a feature which permits both time corrections and corrections for changes in time zones to be accomplished in an easy manner.

Figure 34:
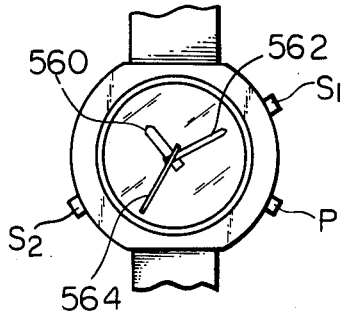
FIG. 34 is a plan view of the external appearance of a 3-hand analog quartz timepiece employing a plurality of push-button type switches for time correction and a single push-button for a click mechanism.

FIG. 34 shows a modified form of the timepiece shown in FIG. 30, with like parts bearing like reference numerals as those used in FIG. 30. In the modification of FIG. 34, the crown-type switch S is replaced with first and second push-button type switches S1 and S2. The movement of the timepiece and the click mechanism controlled by the push button P are the same in construction as that shown in FIG. 32 and, therefore, they are omitted herein for the sake of simplicity of illustration.

Figure 35:
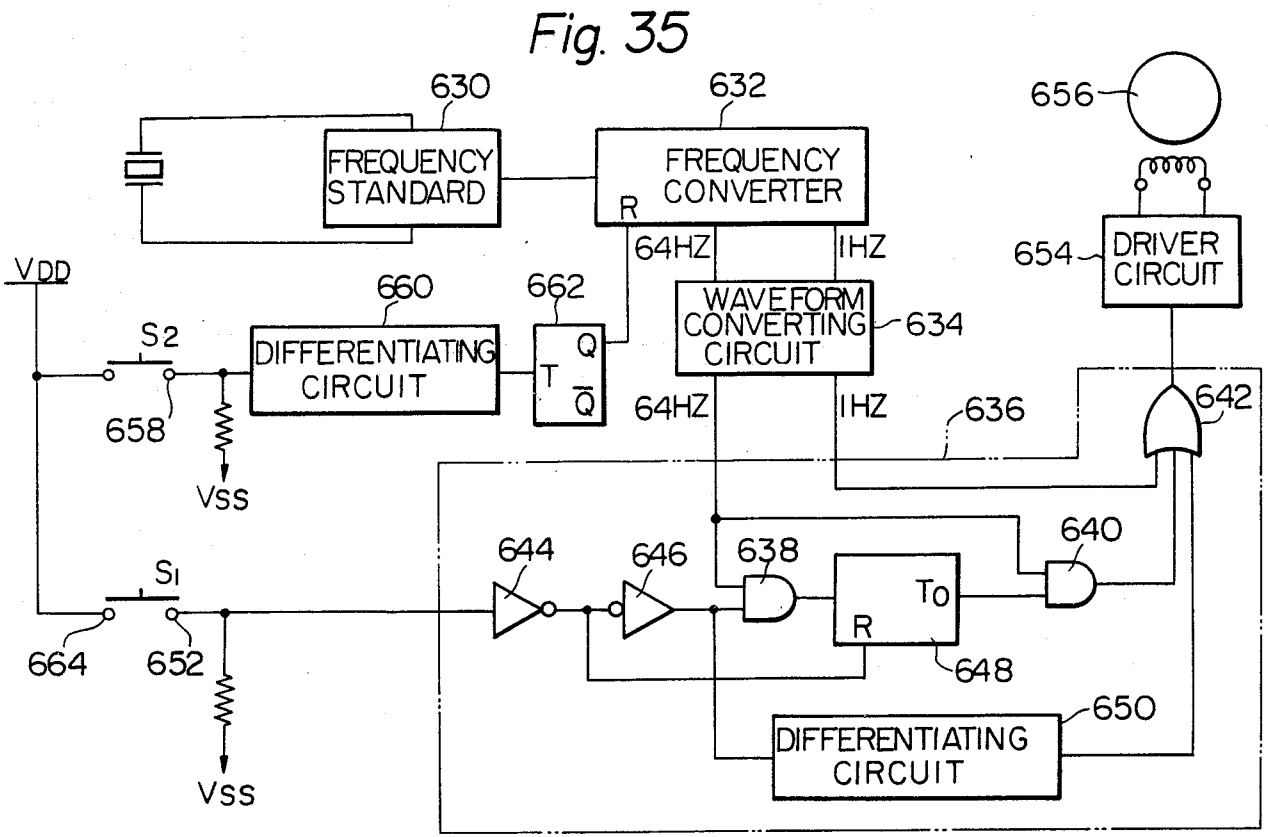
FIG. 35 is a detail block diagram of the electric circuitry for the timepiece shown in FIG. 34.

FIG. 35 shows a bock diagram of the circuitry for the timepiece shown in FIG. 34. In FIG. 35, the reference numeral 630 denotes a frequency standard and 632 a frequency converter which produces a 64 Hz signal and a 1 Hz signal. Each of these signals after being converted to a suitable pulse width by a wave-form converting circuit 634 are then applied as inputs to a correction signal generating circuit 636. The 64 Hz signal is applied to one input terminal of and AND gates 638 and 640 and the 1 Hz signal is applied to one input terminal of an OR gate 642. In addition to the AND gates 638 and 640 and the OR gate 642, the correction signal generating circuit 636 also includes inverters 644 and 646, a timer circuit 648 and a differentiating circuit 650. Contact pin 652 serving as one terminal of the push-button switch S1 is connected to the input of the inverter 644 the output of which is connected to the input of the inverter 646 and the reset terminal R of the timer circuit 648. The output of the inverter 646 is connected to the remaining input terminal of the AND gate 638 and the input of the differentiating circuit 650. The output signal from the AND gate 638 is applied to the input of the timer circuit 648 the output of which is in turn connected to the remaining input of the AND gate 640. Outputs from the AND gate 640 and differentiating circuit 650 together with the 1 Hz signal from the wave-form converting circuit 634 are applied to the inputs of the OR gate 642 which produces output signals to a driver circuit 654 by which a stepping motor 656 is driven. Finally, one terminal 658 of another pushbutton switch S2 is connected across a differentiating circuit 660 to the toggle input terminal T of FF 662 the output terminal Q of which is connected to the reset terminal R of the frequency converter 632.

When the switch S1 is in the normally open state, the contact pin 652 is at a low logic level, the output of the inverter 644 is at a high logic level and the output of the inverter 646 is at a low logic level. Accordingly, the AND gate 638, timer circuit 648, AND gate 640 and differentiating circuit 650 are all held in the OFF state and only the 1 Hz signal is applied to the driver circuit 654 across the OR gate 642. Under these conditions, the stepping motor 656 is driven through one step per second.

Depressing the switch S1 for a short period of time brings the contact pin 652 into contact with a contact spring 664 for an equivalent period to thereby close the switch S1 and instantaneously reverse the aforementioned logical states before they return to their normal logic levels. That is, momentarily before returning to their original states, the contact pin 652 assumes a high logic level, the output of the inverter 644 a low logic level and the output of the inverter 646 a high logic level. As a consequence, the differentiating circuit 650 produces a single correction pulse which is applied across the OR gate 642 as an input signal to the driver circuit 654. This causes the stepping motor 656 to be driven through one step only.

If the switch S1 is kept depressed beyond a prescribed period of time, the switch S1 is closed for an equivalent period and the terminal 652 as well as the outputs of the inverter 644 and inverter 646 all maintain their newly induced states, i.e., high, low and high logic levels, respectively. This renders the AND gate 638 ON for an equivalent period so that the 64 Hz signal is applied as an input to the timer circuit 648. At the same time that the 64 Hz signals as counted by the timer circuit 648 attain a prescribed value, the output terminal To of the timer circuit attains a high logic level which causes the AND gate 640 to open. The 64 Hz signal is thus gated through the AND gate 640 and the OR gate 642 and applied as a correction signal to the driver circuit 654. Accordingly, the motor 656 is driven at a rapid rate by 64 Hz driving pulses. If the switch S1 is now opened, the output of the inverter 644 attains a high logic level, the timer 648 is reset, the AND gates 638 and 640 are inhibited thereby returning the timepiece to the normal operating state.

Every time the switch S2 is closed, the terminal 658 reverses state and attains a high logic level and the differentiating circuit 660 produces a single pulse which causes FF 662 to perform a toggle-like function. Consequently, the frequency converter 632 alternates between the set and reset states every time the switch S2 is closed.

Figure 36:
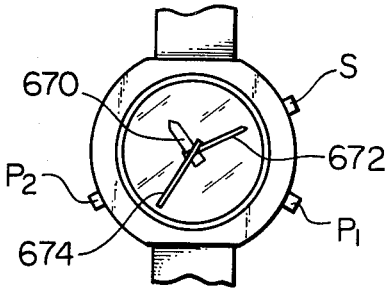
FIG. 36 is a plan view of the external appearance of a 3-hand analog quartz timepiece employing a single push-button switch for time correction and a plurality of push-buttons for controlling a click mechanism.

FIG. 36 is a plan view of the external appearance of still another modified form of the timepiece shown in FIG. 30. In FIG. 36, the timepiece is equipped with a hours hand 670, minutes hand 672 and seconds hand 674 as a time-indicating means and is further provided with 2 push-buttons P1 and P2 and one push-button switch S as external control members. The push-button P1 is the external control member for a click mechanism which shifts only the hours hand 670 step-wise through 30 degree increments, and the push-button P2 is the external control member for a seconds hand zero-reset mechanism.

Figure 37:
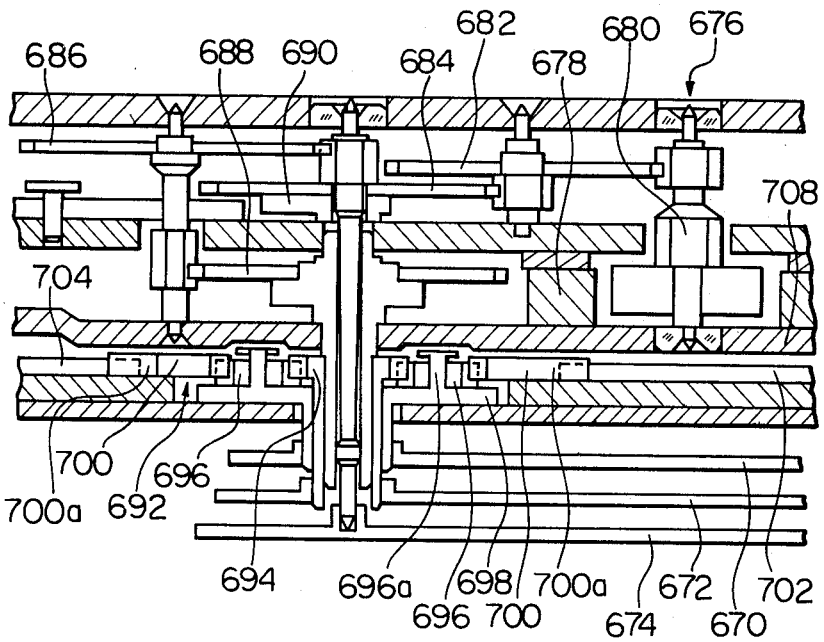
FIG. 37 is a cross section of the movement of the timepiece shown in FIG. 36.
Figure 38:
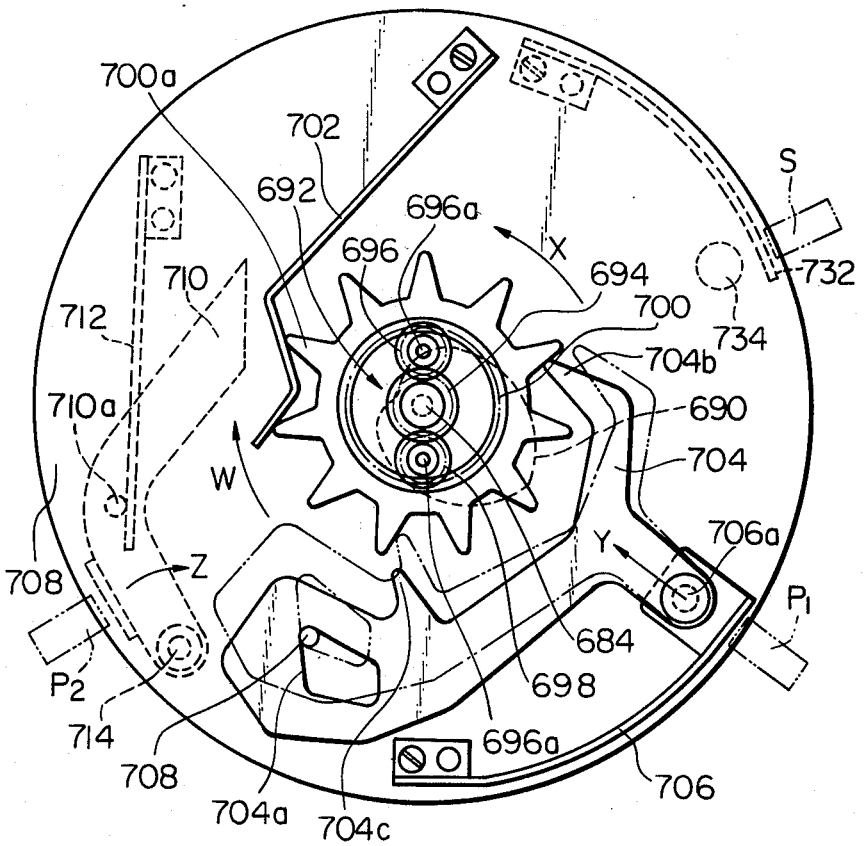
FIG. 38 is a plan view of essential parts of the movement shown in FIG. 37.

FIG. 37 is a cross-sectional view of the movement of the timepiece shown in FIG. 36, and FIG. 38 is a simplified plan view of the click mechanism and seconds hand zero-reset mechanism in which a portion of the components associated with an hours wheel or the like is omitted.

In FIG. 37, a stepping motor 676 which includes a coil (not shown), a stator 678, and a roter 680 is driven by electronic circuitry through one step per second during normal timepiece operation as will be described later. The rotation of the roter 680 is transmitted to 5th wheel and pinion 682, a seconds wheel 684, a 3rd wheel and pinion 686 and minutes wheel 688 in that order. A seconds hand zero-reset heart cam 690 is fixed to one portion of the seconds wheel 684. A differential gear means 692 includes a sun gear 694, which is fixed to one portion of the minutes wheel 688 so as to rotate in unison therewith. The differential gear means 692 includes, in addition to the sun gear 694, two planet gears 696, an hours wheel 698 mounted on a shaft 696*a* of the planet gear 696 and a ring gear 700, the planet gears 696 engaging both the sun gear 694 and the ring gear 700.

In FIG. 38, the outer circumference of the ring gear 700 is provided with 11 triangular teeth 700*a* which engage with a jumper spring 702 to position and hold stationary the ring gear. Thus, the rotation of the sun gear 694 which makes one complete revolution per hour is reduced and transmitted by the gear means 692 thereby rotating through one revolution every 12 hours the hours wheel 698 mounted on the shaft 696*a* of the planet gear 696.

The click mechanism which shifts the hours hand 670 step-wise through increments of 30 degrees operates as follows. In addition to the differential gears means 692 and the jumper spring 702, the click mechanism also includes an hours corrector 704 and an hours corrector spring 706, a push-button P1 being provided as an external control member. A rivet 706*a* secured to a portion of the hours correcter spring 706 serves to provide axial support for the hours corrector 704 so that it is freely rotatable. An elongated hole 704*a* formed in the hours corrector 704 is in engagement with a pin 708*a* projecting from a plate 708. According to this arrangement, the position of the hours corrector 704 is governed by the direction of the force of gravity and the attitude of the timepiece itself; as a result, either of pawls 704*b* or 704*c* of the hours corrector 704 engage the triangular teeth 700*a* of the ring gear 700. In other words, when the timepiece is in an attitude such that the 12:00 o'clock position on the dial is above the 6:00 o'clock position, the weight of the hours corrector 704 brings the pawl 704*b* into engagement with the triangular teeth 700*a*; if the attitude of the timepiece is reversed, the pawl 704*c* will engage the teeth 700*a*.

With the hours corrector 704 in the position indicated by the solid line and the pawl 704*b* engaging the triangular teeth 700*a*, depressing the pushbutton P1 causes the hours corrector spring 706 to push the hours correcter 704 in the direction of arrow Y whereby the pawl 704*b* pushes the triangular teeth 700*a* in the direction of arrow X. As a consequence, the ring gear 692 rotates in the direction of arrow X through one pitch or one-eleventh of a revolution while the hours wheel (FIG. 37) mounted on the shaft 696*a* of the planet gear 696 rotates in the direction of arrow X through one twelfth of a revolution or 30 degrees. The hours hand 670 is thus advanced in a counterclockwise direction through 30 degrees or one hour of time wihout any affect upon the minutes hand 672 and seconds hand 674.

With the hours corrector 704 in the position indicated by the phantom line and the pawl 704*c* engaging the triangular teeth 700*a*, depressing the push-button P1 causes the hours correcter spring 706 to push the hours correcter 704 in the direction of arrow Y whereby the hours hand 670 is now shifted in the direction of arrow W or clockwise through 30 degrees.

In addition to the heart cam 690 fixed to the seconds wheel 684, the seconds hand zero-reset mechanism includes a seconds hand zero-reset lever 710, a seconds hand zero-reset lever spring 712 in engagement with a pin 710*a* projecting from a portion of the seconds hand zero-reset lever 710, and a seconds hand zero-reset lever supporting shaft 714. A push-button P2 is provided as an external control member. Thus, if the push button P2 is depressed when the seconds wheel 684 and hence the seconds hand 674 are at any optional position, the seconds hand zero-reset lever 710 rotates in the direction of arrow Z and engages the heart cam 690 thereby resetting the seconds hand 674 to zero.

Figure 39:
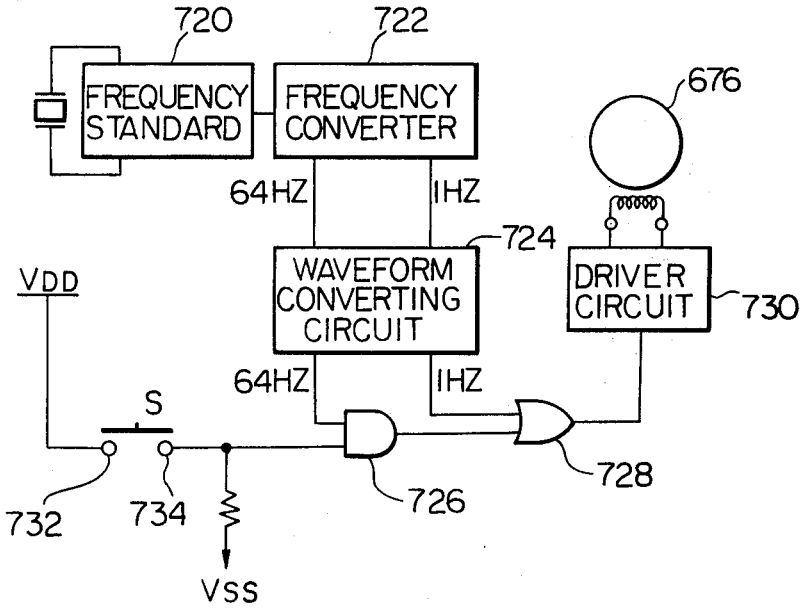
FIG. 39 is a detail block diagram of the electric circuitry for the timepiece shown in FIGS. 36 to 38.

FIG. 39 shows a block diagram of the circuitry for the timepiece shown in FIGS. 36 to 38. In FIG. 39, the reference numeral 720 denotes a frequency standard and 722 a frequency converter which produces a 64 Hz signal and a 1 Hz signal. These signals are converted to a suitable pulse width by a waveform converting circuit 724 and the 64 Hz signal is applied to one input terminal of an AND gate 726 while the 1 Hz signal is applied to one input terminal of an OR gate 728. The remaining input terminal of the AND gate 726 is connected to a contact pin 734 which is one terminal of the switch S while the output of the AND gate 726 is connected to the remaining input terminal of the OR gate 728. Finally, the output of the OR gate 728 is connected to a driver circuit 730.

When the switch S is in the normally open state, the contact pin 734 is at a low logic level and thus the AND gate 726 is inhibited. As a result, only the 1 Hz signal is applied to the driver circuit 730 across the OR gate 728, thereby driving the stepping motor 676 through one step per second.

For a case in which the switch S is depressed, that is, when the contact pin 734 is in contact with the contact spring 732 (see FIG. 38), the contact pin 734 assumes a high logic level and the AND gate 726 is opened. Under these conditions, the 64 Hz signal is also passed by the AND gate 726 and applied to the input of the OR gate 728. As a consequence, the 64 Hz signal is passed by the OR gate 728 and applied to the driver circuit 730 causes the motor 676 to be driven at a high speed of 64 steps per second. The time-indicating means thus advances at a rapid rate.

A time correction can thus be performed in a simple manner by manipulating, either singly or in combination and in conformance with the amount of the desired correction, the push-button P1 for actuating the click mechanism, the push-button P2 for the seconds, hand zero-reset mechanism, and the push-button switch S. In other words, if the degree of timepiece error is within 30 seconds, the second hand can be reset to zero in conformance with a standard time signal. For errors in excess of this range the click mechanism is actuated as required and then the switch S is manipulated to advance the hands of the timepiece at a rapid rate. When this procedure reduces the error to within a range of 30 seconds, it suffices only to reset the second hand to zero.

Figure 40:
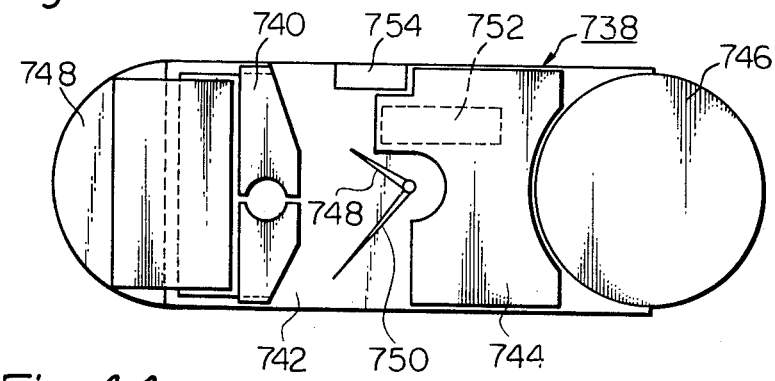
FIGS. 40 to 43 are schematic plan view showing a preferred arrangement of the movement of the timepiece according to the present invention.
Figure 44:
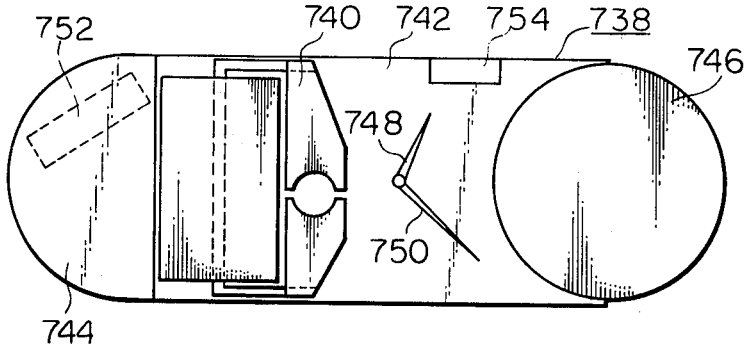
FIG. 44 is a plan view showing another preferred arrangement of the timepiece movement.

FIGS. 40 to 44 show a preferred example of an arrangement of the movement of an analog quartz timepiece in accordance with the present invention. As shown in FIG. 40, the movement 738 comprises a stepping motor 740, a wheel train 742, an electronic circuitry 744 and a battery 746, which are arranged in a substantially linear fashion on a base plate 748. The wheel train 742 is connected to an hours hand 748 and minutes hand 750 which serve as a time-indicating means. A quartz crystal oscillator 752 is disposed at the back of the electronic circuitry 744. Reference numeral 754 denotes a switch block responsive to manipulation of an external control member and operative to rotate the stepping motor 740 so as to perform a time correction of the time-indicating means. According to this construction, the battery 746 serves as the power source while the quartz crystal oscillator 752 and electronic circuitry 744 produces an output signal which rotates the stepping motor 740. This rotation is coupled to the hours hand 748 and minutes hand 750 via the wheel train 742 in order to display the time.

Figure 41:
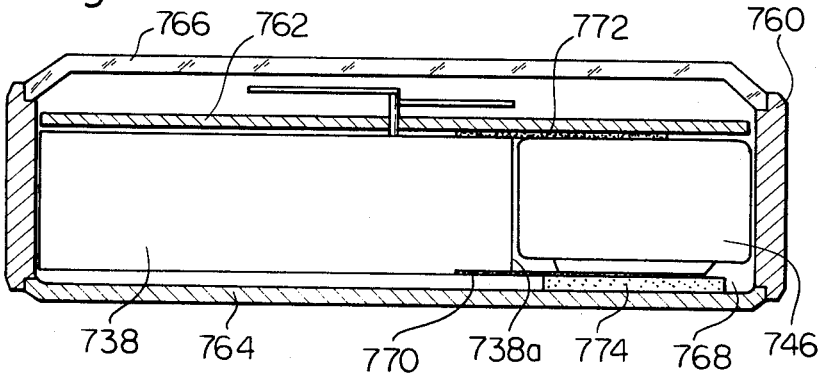
Figure 42:
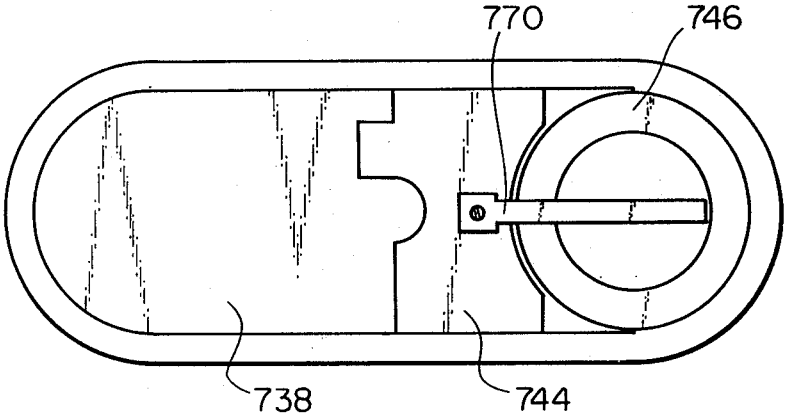

FIG. 41 is a cross section of the movement 738 enclosed in a case and FIG. 42 shows a plan view of the external appearance of the back cover of the case. In FIGS. 41 and 42, reference numeral 760 denotes a case band, 762 a dial, 764 a back cover and 766 a glass, a battery holder 768 being defined by the side **738*a* of the movement 738, the inner periphery of the case band 760 and the dial 762. Reference numerals 770 and 772 designate the battery contacts protruding from the electronic circuitry and composed of an electrically conductive metallic film which is vapor deposited upon the surface of a magnetic sheet. Reference numeral 774 denotes a battery-retaining rubber cushion disposed on the back cover 764**.

According to this arrangement, removing the back cover 764 and installing the battery 746 in the battery holder 768 brings the battery contacts 770 and 772 into contact with the positive and negative electrodes of the battery through the force of magnetic coupling. Thus, even if the battery moves within the confines of the battery holder 768, the flexibility of the battery contacts 770 and 772 eliminates the possibility of chattering. Replacing the back cover 764 restricts longitudinal displacement of the battery while the rubber cushion 774 resiliently retains it. Accordingly, the timepiece can be reduced in thickness since it is not necessary to provide a tension spring adapted in conventional battery retention devices.

Figure 43:
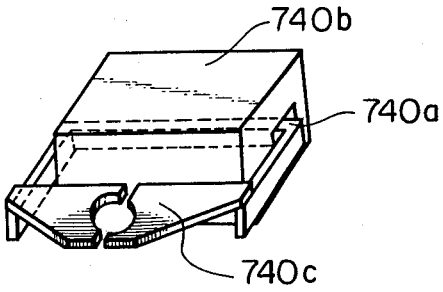

FIG. 43 is a perspective view of the yoke portion of the stepping motor 740 shown in FIG. 40. Winding stem **740*a*, substantially U-shaped and bent at right angles to both sides of coil 740*b*, has fixed to its foremost end a yoke 740*c***. This provides a narrower configuration for the stepping motor than was possible in the prior art.

FIG. 43 shows a modification of the timepiece shown in FIG. 40 with like parts bearing like reference numerals as those used in FIG. 40. In this modification, the electronic circuitry 744, stepping motor 740, wheel train 742 and battery 746 are arranged in that order in a substantially linear fashion on the base plate 748.

The timepiece movement mentioned above therefore provides an elongated, elliptical configuration for a watch which is reduced in thickness and thus suited for utilization as a bracelet watch for women. Extremely compact and yet attractive analog quartz timepieces which have not heretofore been feasible are now capable of being produced.

It will now be appreciated from the foregoing description that in accordance with the present invention a time correction can be easily and accurately performed without requiring a conventional hand setting mechanism, time setting wheels and a slip mechanism. In addition, since a frequency standard or a frequency converter are arranged to be reset, the power can be remarkably conserved when the timepiece is not in use. Moreover, since a time correction circuit embodying the present invention is arranged to permit selection of high speed and low speed correction pulses applied to a stepping motor, the time correction can be completed within the shortest period of time by operating switch means in prescribed fashions.

While the present invention has been shown and described with reference to particular embodiments by way of example, it should be noted that various other changes or modifications may be made without departing from the scope of the present invention.

What is claimed is:

1. An electronic timepiece having a driver circuit to drive an electro-mechanical transducer connected to time-indicating hands to display time information, comprising, in combination:

a frequency standard to provide a relatively high frequency signal;

means for dividing down said relatively high frequency signal to provide a first low frequency signal as a time unit signal and a second low frequency signal at a predetermined higher frequency than said first low frequency signal;

a manually operated external control member adapted to provide set signals when said control member is actuated; and correction signal generating means for generating high speed and low speed correction signals in response to said set signals and comprising first circuit means including timer means for generating an output signal when one of said set signals is maintained at a predetermined logic level for a prescribed time interval and gate means responsive to said output signal and said second low frequency signal to provide said high speed correction signal of said predetermined higher frequency, and second circuit means responsive to said set signals to provide said low speed correction signals when said external control member is actuated for a short time interval less than said prescribed time interval;

said driver circuit being normally responsive to said time unit signal to drive said electro-mechanical transducer to advance said time-indicating hands at a normal speed and responsive to said high speed correction signal of said predetermined higher frequency to drive said electro-mechanical transducer so as to advance said time-indicating hands at a higher than normal speed, said driver circuit being also responsive to said low speed correction signals to drive said electro-mechanical transducer so as to advance said time-indicating hands a predetermined number of steps when said external control member is actuated for said short time interval.

2. An electronic timepiece according to claim 1, in which said timer comprises a reset terminal coupled through a first invention to said external control member.

3. An electronic timepiece according to claim 1, in which said second circuit means comprises a differentiating circuit for generating said second correction signal when said external control member is actuated for a second prescribed time interval less than said first prescribed time interval.

4. An electronic timepiece according to claim 3, in which said second circuit means further comprises a flip-flop responsive to said low speed correction signals to generate a reset signal at its first output, and gate means for passing said low speed correction signals to said driver circuit in response to a second output of said flip-flop, the first output of said flip-flop being coupled to a reset terminal of said dividing means.

5. An electronic timepiece according to claim 3, in which said second circuit means further comprises a second differentiating circuit to generate a differentiation pulse in response to the output signal from said timer means, and a flip-flop responsive to said differentiation pulse to generate a reset signal, an output of said flip-flop being coupled to reset terminals of said frequency standard and said dividing means.

6. An electronic timepiece according to claim 3, in which said second circuit means further comprises a counter circuit coupled to the output of said differentiating circuit and generating a reset signal when the count in said counter circuit reaches a predetermined value, an output of said counter circuit being coupled to reset terminals of said frequency standard and said dividing means.

7. An electronic timepiece having a driver circuit to drive an electro-mechanical transducer connected to time-indicating hands to display time information, comprising, in combination: a frequency standard to provide a relatively high frequency signal; means for dividing down said relatively high frequency signal to provide a first low frequency signal as a time unit signal and a second low frequency signal higher in frequency than said first low frequency signal; a manually operated external control member adapted to generate a set signal when it is actuated; means for generating first and second correction signals in response to said set signal; gate means for selectively passing said first low frequency signal and said correction signals to said driver circuit; said dividing means providing a third low frequency signal lower in frequency than said second low frequency signal; and said correction signal generating means comprising first and second inverters connected in series with said external control member, a first control gate responsive to said set signal to gate said second low frequency signal therethrough, first and second timer circuits coupled in parallel to an output of said first control gate, said first timer circuit generating a first output signal when the count in said first timer circuit reaches a first prescribed value while said second timer circuit generates a second output signal when the count in said second timer circuit reaches a second prescribed value, a second control gate responsive to said second output signal to pass said second low frequency signal as said first correction signal to said driver circuit through said gate means, and a third control gate responsive to said first output signal to pass said third low frequency signal as said second correction signal to said driver circuit through said gate means.

8. An electronic timepiece according to claim 7, in which said correction signal generating means further comprises a first differentiating circuit coupled to said first timer circuit to generate a first differentiation pulse, a second differentiating circuit coupled to said second timer circuit to generate a second differentiation pulse, a third differentiating circuit coupled to the output of said second inverter to generate a third differentiation pulse, and a flip-flop adapted to be set in response to said first differentiation pulse to generate a reset signal and reset in response to one of said second and third differentiation pulses, said reset signal being applied to reset terminals of said frequency standard and said dividing means.

9. An electronic timepiece having a driver circuit to drive an electro-mechanical transducer connected to time-indicating hands to display time information, comprising, in combination:

a frequency standard to provide a relatively high frequency signal;

means for dividing down said relatively high frequency signal to provide a first low frequency signal as a time unit signal and a second low frequency signal higher in frequency than said first low frequency signal;

a manually operated external control member adapted to generate a set signal when it is actuated;

means for generating first and second correction signals in response to said set signal; and gate means for selectivey passing said first low frequency signal and said correction signals to said driver circuit;

said dividing means comprising a frequency converter coupled to said frequency standard to generate said second low frequency signal, a first counter coupled to said frequency converter to generate a third low frequency signal lower in frequency than said second low frequency signal, a second counter coupled to said first counter to generate said first low frequency signal, a control gate having its one input coupled to said second counter, and a third counter coupled to an output of said control gate; and said correction signal generating means comprising a first selection gate connected between said first counter and said gate means, a second selection gate connected between said frequency converter and said gate means, and means for alternately generating first and second selection signals in response to sequential operations of said external control member, said first selection gate being responsive to said first selection signal to pass said third low frequency signal to said driver circuit through said gate means, and said second selection gate being responsive to said second selection signal to pass said second low frequency signal to said driver circuit through said gate means.

10. An electronic timepiece according to claim 9, in which said selection signal generating means comprises a flip-flop having its input coupled to said external control member and first and second outputs, a first AND gate responsive to said set signal and said first output of said flip-flop to generate said first selection signal, and a second AND gate responsive to said set signal and said second output of said flip-flop to generate said second selection signal.

11. An electronic timepiece according to claim 10, in which said control gate is responsive to said second selection signal to connect said third counter to said second counter in series to provide a time counter which counts said second low frequency signal and generates an output signal when the count in said time counter reaches a predetermined value, and further comprising a differentiating circuit for generating a differentiation pulse in response to said second selection signal, said differentiation pulse being applied to said first, second and third counters of said time counter to reset these counters before said time counter begins to count, and a flip-flop responsive to said output signal from said time counter to generate an output signal to halt the operation of said frequency standard.

12. An electronic timepiece according to claim 10, in which said control gate is responsive to said first selection signal to connect said third counter to said second counter in series to provide a time counter which counts said third low frequency signal and generates an output signal when the count in said time counter reaches a second predetermined value, and further comprising a differentiating circuit for generating a differentiation pulse in response to said first selection signal, said differentiation pulse being applied to said first, second and third counters of said time counter to reset these counters before said time counter begins to count, and a flip-flop responsive to the output signal from said time counter to generate an output signal to halt the operation of said frequency standard.

13. An electronic timepiece having a driver circuit to drive an electro-mechanical transducer connected to time-indicating hands to display time information, comprising, in combination:

a frequency standard to provide a relatively high frequency signal; means for dividing down said relatively high frequency signal to provide a first low frequency signal as a time unit signal and a second low frequency signal higher in frequency than said first low frequency signal;

a manually operated external control member adapted to generate a set signal when it is actuated;

means for generating first and second correction signals in response to said set signal; and gate means for passing said first low frequency signal and said correction signals to said driver cirucuit;

said correction signal generating means comprising a differentiating circuit for generating said second correction signal in response to said set signal, first gate means for detecting when said external control member is actuated for a first predetermined time interval and generating a first output signal, a first flip-flop responsive to said first output signal to generate a second output signal, and second gate means responsive to said second output signal and said second low frequency signal to generate said first correction signal;

said correction signal generating means further comprising means for generating a reset signal to halt the operation of said frequency standard when a second predetermined time interval has elapsed after said first predetermined time interval.

14. An electronic timepiece according to claim 13, in which said dividing means comprises a frequency converter to provide said second low frequency signal and a seconds counter composed of a plurality of flip-flops connected in series with said frequency converter to provide said first low frequency signal, and in which said reset signal generating means comprises third gate means responsive to said first low frequency signal and said second output signal to generate a third output signal, a second flip-flop responsive to said third output signal to generate a fourth output signal, an external control terminal adapted to provide a control input, and fourth gate means responsive to said fourth output signal, outputs from predetermined stages of said seconds counter and said control input for generating said reset signal which is applied to said frequency standard.

15. An electronic timepiece according to claim 13, in which said second gate means comprises a first AND gate for generating a fifth output signal in response to said set signal from said external control member and said second output signal, said fifth output signal being applied as a reset signal to reset terminals of said seconds counter and said frequency converter.

16. An electronic timepiece having a driver circuit to drive an electro-mechanical transducer connected to time-indicating hands to display time information, comprising, in combination:

a frequency standard to provide a relatively high frequency signal;

means for dividing down said relatively high frequency signal to provide a predetermined frequency signal, a first low frequency signal as a time unit signal, and a second low frequency signal at higher frequency than said first low frequency signal;

a manually operated external control member adapted to generate a set signal when it is actuated;

means for generating first and second correction signals in response to said set signal;

gate means for passing said first low frequency signal and said correction signals to said driver circuit;

means for generating an output signal having a narrow pulse width in response to said predetermined frequency signal; and a driver circuit including means for generating said drive signal in response to said output signal, said drive signal comprising an advance degree measurement signal indicative of an advance degree of said electro-mechanical transducer;

said driver circuit including a flip-flop coupled to an output of said gate means and having first and second outputs, a first NAND gate having its one input coupled to the output of said gate means and another input coupled to the first output of said flip-flop, and a second NAND gate having its one input coupled to the output of said gate means and another input coupled to the second output of said flip-flop.

17. An electronic timepiece according to claim 16, in which said means of said driver circuit comprises a third NAND gate having one input coupled to an output of said output signal generating means and another input coupled to an output of said first NAND gate.

18. An electronic timepiece according to claim 17, in which said advance degree measurement signal has a frequency of 1 Hz.

19. An electronic timepiece having a driver circuit to drive an electro-mechanical transducer connected to time-indicating hands to display time information, comprising, in combination:

a frequency standard to provide a relatively high frequency signal;

means for dividing down said relatively high frequency signal to provide a first low frequency signal as a time unit signal and a second low frequency signal at a predetermined higher frequency than said first low frequency signal;

a manually operated external control member adapted to provide set signals when each time said control member is actuated; and correction signal generating means for generating high speed and low speed correction signals in response to said set signals and comprising first circuit means including timer means for generating an output signal when one of said set signals is maintained at a predetermined logic level for a prescribed time interval and gate means responsive to said output signal and said second low frequency signal to provide said high speed correction signal of said predetermined higher frequency, and second circuit means responsive to said set signals to provide said low speed correction signals when said external control member is actuated for a short time interval less than said prescribed time interval;

said driver circuit being normally responsive to said time unit signal to drive said electro-mechanical transducer to advance said time-indicating hands at a normal speed and responsive to said high speed correction signal of said predetermined higher frequency to drive said electro-mechanical transducer so as to advance said time-indicating hands at a higher than normal speed, said driver circuit being also responsive to said low speed correction signals to drive said electro-mechanical transducer so as to advance said time-indicating hands a predetermined number of steps when said external control member is actuated for said short time interval;

said external control member including a push-button mounted at a portion of a case of said timepiece anywhere between the positions corresponding to 8:00 and 10:00 o'clock on a dial.

20. An electronic timepiece according to claim 19, in which a movement of the timepiece is barrel-shaped.

21. An electronic timepiece having a driver circuit to drive an electro-mechanical transducer connected to time-indicating hands to display time information, comprising, in combination:

a frequency standard to provide a relatively high frequency signal;

means for dividing down said relatively high frequency signal to provide a first low frequency signal as a time unit signal and a second low frequency signal higher in frequency than said first low frequency signal;

a manually operated external control member composed of a crown associated with a switch and adapted to generate a set signal when it is actuated;

means for generating first and second correction signals in response to said set signal;

gate means for selectively passing said first low frequency signal and said correction signals to said driver circuit;

said dividing means comprising a frequency converter which also produces a third low frequency signal lower in frequency than said second low frequency signal; and said correction signal generating means including first and second correction control terminals to which said switch is selectively connectable when said crown is operated, a first AND gate having one input coupled to said first correction control terminal and another input coupled to said frequency converter to receive said second low frequency signal therefrom and generating said first correction signal when said switch is connected to said first correction control terminal to cause said electro-mechanical transducer to advance at a first speed, and a second AND gate having one input coupled to said second correction control terminal and another input coupled to said frequency converter to receive said third low frequency signal therefrom and generating said second correction signal when said switch is connected to second correction control terminal to cause said electro-mechanical transducer to advance at a second speed.

22. An electronic timepiece according to claim 21, in which said correction signal generating means further comprises a NOR gate having its inputs coupled to said first and second correction control terminals, and a third AND gate having its one input coupled to receive said first low frequency signal, another input coupled to an output of said NOR gate, and an output coupled to said driver circuit through to said gate means.

23. An electronic timepiece according to claim 21, in which said correction signal generating means further comprises a third correction control terminal, and a differentiating circuit connected to said third correction control terminal to generate a single correction pulse each time said switch is connected to said third correction control terminal, said single correction pulse being applied through said gate means to said driver circuit to cause said electro-mechanical transducer to advance one step.

24. An electronic timepiece according to claim 22, in which said correction signal generating means further comprises a fourth correction control terminal connected to a reset terminal of said frequency converter to reset the same when said switch is connected to said fourth correction control terminal.

25. An electronic timepiece according to claim 24, in which said correction signal generating means further comprises a fifth correction control terminal, and switching means connected to said fifth correction control terminal to halt the operation of said frequency standard when said switch is connected to said fifth correction control terminal.

26. An electronic timepiece according to claim 22, further comprising means for generating third correction signals in response to said second low frequency signal, second gate means connected to said second correction signal generating means to pass said third correction signal therethrough, and a second driver circuit connected to an output of said second gate means to drive said electro-mechanical transducer in a counter-clockwise direction to perform a time correction in response to said third correction signals.

27. An electronic timepiece having a driver circuit to drive an electro-mechanical transducer connected to time-indicating hands to display time information, comprising, in combination:

a frequency standard to provide a relatively high frequency signal;

means for dividing down said relatively high frequency signal to provide a first low frequency signal as a time unit signal and a second low frequency signal higher in frequency than said first low frequency signal;

manually operated external control members adapted to generate set signals when they are actuated, said external control members comprise first and second push-buttons;

means for generating first and second correction signals in response to said set signal;

gate means for selectively passing said first low frequency signal and said correction signals to said driver circuit;

said correction signal generating means comprising first and second switches adapted to be opened and closed by said first and second push-buttons, a first control gate for generating said first correction signal in response to said second low frequency signal when said first switch is closed, and means for generating said second correction signal which contains a predetermined number of pulses when said second switch is closed, said second correction signal being applied through said gate means to said driver circuit to cause said electro-mechanical transducer to advance predetermined number of steps, said second correction signal generating means including a differentiating circuit coupled to said second switch and generating a differentiation pulse when said second switch is closed, a first flip-flop responsive to said differentiation pulse to generate a first output signal, a second control gate responsive to said second low frequency signal and said first output signal to generate said second correction signal, and a counter having an input coupled to an output of said second control gate to count pulses of said low speed correction signal and generate an output when the count reaches a predetermined value, the output of said counter being applied as a reset signal to a reset terminal of said first flip-flop whereby said flip-flop is reset to inhibit said second control gate such that said second correction signal contains said predetermined number of pulses.

28. An electronic timepiece according to claim 27, in which said output of said counter is coupled to a reset terminal of said dividing means.

29. An electronic timepiece according to claim 28, in which said correction signal generating means further comprises a third control gate having inputs coupled to said first and second switches and generating an output signal when both of said first and second switches are closed, a second flip-flop responsive to the output signal from said third control gate to generate a second output signal, and switching means responsive to said second output signal to halt the operation of said frequency standard.

30. An electronic timepiece having a driver circuit to drive an electro-mechanical transducer connected to time-indicating hands to display time information, comprising, in combination:

a frequency standard to provide a relatively high frequency signal;

means for dividing down said relatively high frequency signal to provide a first low frequency signal as a time unit signal and a second low frequency signal higher in frequency than said first low frequency signal;

a manually operable external control member adapted to generate a set signal when it is actuated;

means for generating first and second correction signals in response to said set signal; and gate means for passing said first low frequency signal and said correction signals to said driver circuit;

said correction signal generating means comprising timer means for generating an output signal when said set signal is maintained at a predetermined logic level for a first prescribed time interval, said timer means having a reset terminal coupled through a first inverter to said external control member, first control gate means responsive to said output signal from said timer means and said second low frequency signal to generate said first correction signal, a first differentiating circuit for generating a first differentiation pulse in response to said set signal, a first flip-flop responsive to said first differentiation pulse to generate a first output signal, second control gate means responsive to said second low frequency signal and said first output signal to produce said correction signal which is applied through said gate means to said driver circuit, and reset signal generating means coupled to an output of said gate means to generate a reset signal when the number of pulses of said second correction signal generated by said second control gate means reaches a predetermined value, said reset signal being applied to a reset terminal of said first flip-flop whereby said first flip-flop is reset to inhibit said second control gate means whereby said second correction signal contains a predetermined number of pulses to cause said driver circuit to drive said electro-mechanical transducer to advance predetermined steps each time said external control member is actuated for a short period of time.

31. An electronic timepiece according to claim 30, in which said reset signal generating means comprises a second flip-flop responsive to the output of said gate means to generate a second output signal, and a second differentiating circuit responsive to said second output signal to generate said reset signal.

32. An electronic timepiece according to claim 31, in which said correction signal generating means further comprises a third flip-flop responsive to said first differentiation pulse to generate a third output signal, and a fourth control gate responsive to said reset signal from said second differentiating circuit and said third output signal to generate an output signal which is applied to a reset terminal of said dividing means.

33. An electronic timepiece having a driver circuit to drive an electro-mechanical transducer connected to time-indicating hands to display time information, comprising, in combination:

a frequency standard to provide a relatively high frequency signal;

means for dividing down said relatively high frequency signal to provide a first low frequency signal as a time unit signal and a second low frequency signal at a predetermined higher frequency than said first low frequency signal;

first, second and third manually operated external control members adapted to provide set signals when said first external control member is actuated;

correction signal generating means for generating high speed and low speed correction signals in response to said set signals and comprising first circuit means including timer means for generating an output signal when one of said set signals is maintained at a predetermined logic level for a prescribed time interval and gate means responsive to said output signal and said second low frequency signal to generate said high speed correction signal of said predetermined higher frequency, and second circuit means responsive to said set signals to provide said low speed correction signal when said control member is actuated for a short time interval less than said prescribed time interval;

said driver circuit being normally responsive to said time unit signal to drive said electro-mechanical transducer to advance said time-indicating hands at a normal speed, responsive to said high speed correction signal of said predetermined higher frequency to drive said electro-mechanical transducer so as to advance said time-indicating hands at a higher than normal speed, and responsive to said low speed correction signals to drive said electro-mechanical transducer so as to advance said time-indicating hands by a predetermined number of steps when said external control member is actuated for said short time interval; and a clock mechanism actuated by said second external control member for shifting the hours hand step-wise.

34. An electronic timepiece according to claim 33, in which said click mechanism comprises gear means meshing with an hours wheel connected to said hours wheel for rotation therewith and having a plurality of teeth formed thereon, a jumper spring to hold said gear means stationary, an hours corrector spring movable by said second external control member, and an hours corrector pivotally connected to an end portion of said hours corrector spring to be movable therewith, said hours corrector including first and second pawls each engageable with a selected one of said plurality of teeth to rotate said gear means in a selected direction against the action of said jumper spring for thereby shifting said hours hand step-wise.

35. An electronic timepiece according to claim 33, further comprising a seconds hand zero-reset mechanism for resetting said seconds hand to zero when actuated by said third external control member.

36. An electronic timepiece according to claim 35, in which said seconds hand zero-reset mechanism comprises cam means connected to a seconds wheel of said seconds hand, a seconds hand zero-reset lever pivotally mounted on a plate of the timepiece and rotatable by said third external control member, and spring means for normally holding said zero-reset lever out of engagement with said cam means, said zero-reset lever being engageable with said cam means against the action of said spring means when said zero-reset lever is actuated by said third external control member for thereby resetting said seconds hand to zero.

37. An electronic timepiece having an electro-mechanical transducer connected to time-indicating hands to display time information, comprising, in combination:

a frequency standard to provide a relatively high frequency signal;

means for dividing down said relatively high frequency signal to provide a predetermined frequency signal, a first low frequency signal as a time unit signal lower in frequency than said predetermined frequency signal and a second low frequency signal at a predetermined higher frequency than said first low frequency signal;

a manually operated external control member adapted to provide set signals when each time said control member is actuated; and correction signal generating means for generating high speed and low speed correction signals in response to said set signals and comprising first circuit means including timer means for generating an output signal when one of said set signals is maintained at a predetermined logic level for a prescribed time interval and gate means responsive to said output signal and said second low frequency signal to provide said high speed correction signal of said predetermined higher frequency, and second circuit means responsive to said set signals to provide said low speed correction signals when said external control member is actuated for a short time interval less than said prescribed time interval;

means for producing a train of output pulses of a narrow pulse width in response to said predetermined frequency signal; and a driver circuit responsive to said time unit signal and said train of output pulses to provide a drive signal composed of drive pulses of a first pulse width and train of pulses of a second pulse width narrower than said first pulse width and appearing between said drive pulses at equally spaced time instants, with said train of pulses being able to be used for measuring an advance degree of said electro-mechanical transducer;

said driver circuit being normally responsive to said drive signal to drive said electro-mechanical transducer to advance said time-indicating hands at a normal speed and responsive to said high speed correction signal of said predetermined higher frequency to drive said electro-mechanical transducer so as to advance said time-indicating hands at a higher than normal speed, said driver circuit being also responsive to said low speed correction signals to drive said electro-mechanical transducer so as to advance said time-indicating hands a predetermined number of steps when said external control member is actuated for said short time interval.

* * * * *